US008036589B2

(12) United States Patent
Gaman

(10) Patent No.: US 8,036,589 B2
(45) Date of Patent: Oct. 11, 2011

(54) IMAGE FORMING APPARATUS INCLUDING A STOPPING UNIT AND METHOD OF FORMING IMAGE

(75) Inventor: Yasuharu Gaman, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 783 days.

(21) Appl. No.: 12/068,580

(22) Filed: Feb. 8, 2008

(65) Prior Publication Data

US 2008/0232881 A1 Sep. 25, 2008

(30) Foreign Application Priority Data

Mar. 19, 2007 (JP) ..... 2007-071333
Oct. 30, 2007 (JP) ..... 2007-281804

(51) Int. Cl.
*G03G 15/00* (2006.01)

(52) U.S. Cl. ..... 399/402; 399/400; 399/401; 399/67; 399/68; 271/3.16

(58) Field of Classification Search ..... 399/401, 399/402, 382; 271/3.15, 3.16
See application file for complete search history.

(56) References Cited

U.S. PATENT DOCUMENTS

| | | | | |
|---|---|---|---|---|
| 5,961,111 | A * | 10/1999 | Kurata et al. | 271/3.03 |
| 6,047,148 | A * | 4/2000 | Nagatani et al. | 399/66 |
| 6,144,814 | A * | 11/2000 | Newell et al. | 399/16 |
| 7,878,503 | B2 * | 2/2011 | Deckard | 271/228 |
| 2001/0028819 | A1 * | 10/2001 | Okamoto | 399/401 |
| 2002/0118989 | A1 * | 8/2002 | Tokutake et al. | 399/401 |
| 2006/0164456 | A1 | 7/2006 | Yamagishi et al. | |

FOREIGN PATENT DOCUMENTS

| | | |
|---|---|---|
| JP | 10-268710 | 10/1998 |
| JP | 11-143138 | 5/1999 |
| JP | 2000-330408 | 11/2000 |
| JP | 2002-116590 | 4/2002 |

* cited by examiner

*Primary Examiner* — Matthew G Marini
(74) *Attorney, Agent, or Firm* — Harness, Dickey & Pierce, P.L.C.

(57) ABSTRACT

In an image forming apparatus, a recording medium is temporarily stopped at an upstream of a fixing unit when the recording medium needs to be stopped for a longer time between the fixing unit and a curved path.

11 Claims, 20 Drawing Sheets

IMAGE FORMING APPARATUS INCLUDING A STOPPING UNIT AND METHOD OF FORMING IMAGE

CROSS-REFERENCE TO RELATED APPLICATIONS

The present application claims priority to and incorporates by reference the entire contents of Japanese priority document 2007-071333 filed in Japan on Mar. 19, 2007 and 2007-281804 filed in Japan on Oct. 30, 2007.

BACKGROUND OF THE INVENTION

1. Field of the Invention

The present invention relates to an image forming apparatus, and more particularly, to an image forming apparatus that has a function of forming an image on both sides of a sheet and a method thereof.

2. Description of the Related Art

Image forming apparatuses disclosed in Japanese Patent Application Laid-open Nos. H11-143138 and 2002-116590 and Japanese Patent Publication No. 3544279, for example, are well-known as an image forming apparatus that has a function of forming an image on both sides of a sheet. To improve operation efficiency in forming an image on both sides of a plurality of sheets, Japanese Patent Application Laid-open No. H11-143138 discloses interleaf control in which images are formed on one sides of two or more sheets between image formations on one side and the other side of a first sheet based on image data stored.

Japanese Patent Application Laid-open No. 2002-116590 discloses a technology to appropriately convey sheets to an image forming unit. According to the technology, at a point that a sheet feeding sensor detects a trailing edge of a sheet, the following sheet is fed by a pick-up roller and a feed roller. At a point that the sheet feeding sensor detects a leading edge of the following sheet, the feed roller is stopped. Time $T_1$ taken from the start of driving the feed roller to feed the following sheet to the detection of the leading edge of the following sheet by the sheet feeding sensor is calculated. The feed roller is driven again after a period $T-T_1$ has elapsed since the feed roller is stopped, where T is a minimum time interval required from feeding of the preceding sheet by registration rollers to feeding of the following sheet.

Japanese Patent Publication No. 3544279 discloses another technology. According to the technology, because a possibility of a jam changes depending on a curl amount of an edge of a sheet when the sheet is reversed, a conveying roller is arranged not to come into contact with a sheet that has a small curl amount when the sheet passes along a path.

In some image forming apparatuses such as those in the technologies as described above, especially in image forming apparatuses having a function of duplex printing, a sheet conveying path sharply changes its conveying direction after an image is fixed for saving space. The image forming apparatus having a function of duplex printing needs to convey a sheet to a double-sided sheet conveying unit after an image is fixed on one side of the sheet. For saving a space, the double-sided sheet conveying unit and an image forming unit are often arranged such that they are projected at the same position, for example, the double-sided sheet conveying unit is arranged downward of the image forming unit. Therefore, the sheet is conveyed to the double-sided sheet conveying unit while being turned by 90 degrees or more to about 180 degrees.

However, if a sheet is turned sharply after an image on the sheet is fixed thereto at the fixing unit, the sheet may jam due to the variation of the states of sheets that are conveyed. Especially, when interleaf control is performed to efficiently form images, a plurality of sheets are moving and temporarily stop in the sheet conveying path. Moreover, the order of sheets being conveyed is complicated. Therefore, when a jam occurs in the sheet conveying path, jam recovery processing is more complicated.

Thus it is desired to suppress a sheet jam between a sheet reversing path and a double-sided sheet conveying path.

SUMMARY OF THE INVENTION

It is an object of the present invention to at least partially solve the problems in the conventional technology.

According to an aspect of the present invention, there is provided an image forming apparatus that includes an image forming mechanism that forms an image on a first side of a recording medium a fixing unit that fixes an image on the recording medium; a reversing unit that is located at a downstream of the fixing unit, that includes a curved path having a large curvature for conveying the recording medium, and that reverses the recording medium and conveys the recording medium again to the image forming mechanism for forming an image on a second side of the recording medium; and a stopping unit that temporarily stops the recording medium at an upstream of the fixing unit when the recording medium needs to be stopped for a longer time between the fixing unit and the curved path.

According to another aspect of the present invention, there is provided an image forming apparatus that includes an image forming mechanism that forms an image on a first side of a recording medium; a fixing unit that fixes an image on the recording medium; and a reversing unit that is located at a downstream of the fixing unit, that includes a curved path, and that reverses a conveying direction of the recording medium and conveys the recording medium again to the image forming mechanism for forming an image on a second side of the recording medium; and a control unit that controls such that when the recording medium temporarily stops at a downstream of the curved path and at an upstream of the image forming mechanism, a subsequent recording medium following the recording sheet does not stop in a position at the downstream of the fixing unit and before being reversed by the curved path.

According to still another aspect of the present invention, there is provided an image forming method that is implemented on an image forming apparatus including an image forming mechanism that forms an image on a recording medium, a fixing unit that fixes an image on the recording medium, and a reversing unit that is located at a downstream of the fixing unit, that includes a curved path having a large curvature for conveying the recording medium, and that reverses the recording medium.

The image forming method includes temporarily stopping the recording medium at an upstream of the fixing unit when the recording medium needs to be stopped for a longer time between the fixing unit and the curved path. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
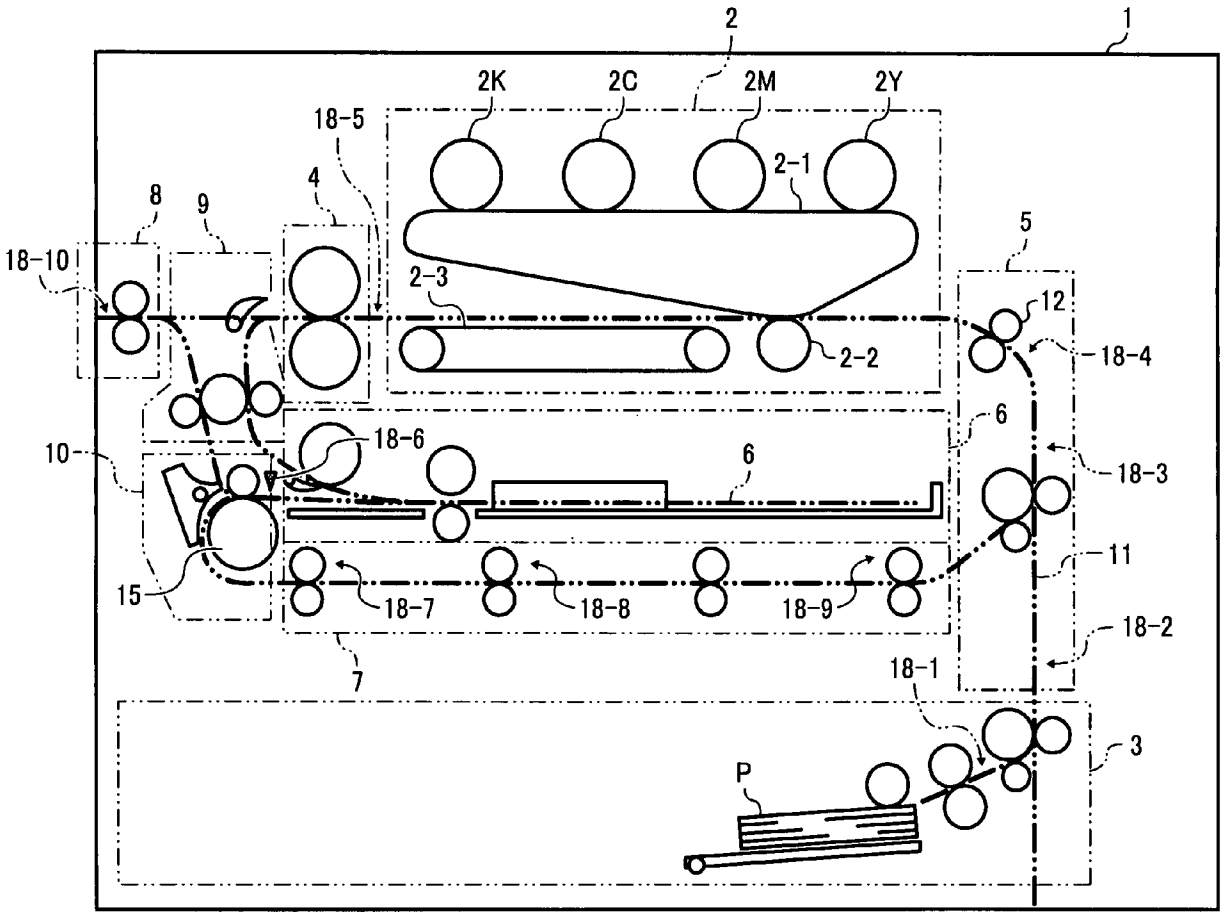
FIG. 1 is a schematic diagram of an inner configuration of an image forming apparatus according to an embodiment of the present invention.

FIG. 1 is a schematic diagram of an inner configuration of an image forming apparatus 1 according to an embodiment of the present invention. The image forming apparatus 1 includes an image forming unit 2, a sheet feeding unit 3, a fixing unit 4, a sheet conveying unit 5, a reversing unit 6, a double-sided sheet feeding unit 7, a sheet discharging unit 8, a reversed sheet discharging path unit 9, and a sheet turning unit 10.

When an image is formed on one side of a sheet in the image forming apparatus 1, a sheet P in the sheet feeding unit 3 is fed to a pair of registration rollers 12 through a vertical conveying path 11 of the sheet conveying unit 5, and is fed to the image forming unit 2 while being synchronized with a leading edge of an image formed in the image forming unit 2. The image forming apparatus 1 is a tandem color image forming apparatus that has an indirect transfer system, and includes four photosensitive drums 2Y, 2M, 2C, and 2K on which toner images of Y, M, C, and K are formed, respectively, an intermediate transfer belt 2-1 on which each of the toner images formed on the photosensitive drums 2Y, 2M, 2C, and 2K is superimposed, a secondary transfer roller 2-2 by which a full-color image formed by superimposing the toner images on the intermediate transfer belt 2-1 is transferred onto the sheet P, and a conveying belt 2-3 that conveys the sheet P onto which the full-color image is transferred onto the fixing unit 4. The term "sheet" includes a typical sheet-shaped recording medium on both sides of which an image can be formed.

The sheet P fed to the image forming unit 2 is sent to a nip between the intermediate transfer belt 2-1 and the secondary transfer roller 2-2. When the sheet P passes through the nip between both of them, color images (four color images in this case) are transferred from the intermediate transfer belt 2-1 onto the sheet P. The color images that are superimposed on the sheet P are fixed to the sheet P in the fixing unit 4. The sheet P is sent to the reversing unit 6 (a portion that is downstream of the fixing unit 4 and before the sheet P is reversed by a turn roller 15) through the reversed sheet discharging path unit 9. The sheet P is reversed at the reversing unit 6 and is discharged through the sheet discharging unit 8.

When an image is formed on both sides of a sheet, the sheet P in the sheet feeding unit 3 is sent to the image forming unit 2 through the sheet conveying unit 5 that extends vertically. An image is transferred onto a first side (a front side) of the sheet P in the image forming unit 2, and the transferred image is fixed to the sheet P in the fixing unit 4. Then, the sheet P is conveyed to and reversed in the reversing unit 6.

The reversed sheet P is conveyed in an opposite direction toward the double-sided sheet feeding unit 7 (a leading edge of the sheet P when entering the reversing unit 6 changes to a trailing edge thereof when carried out of the reversing unit 6), and is sent through the double-sided sheet feeding unit 7 and the sheet conveying unit 5 to the image forming unit 2 again. In the image forming unit 2, as described above, an image on the intermediate transfer belt 2-1 is transferred onto a second side (a back side) of the sheet P, and the transferred image is fixed to the sheet P in the fixing unit 4. The sheet P with the images formed on both sides is discharged through the sheet discharging unit 8.

Figure 2:
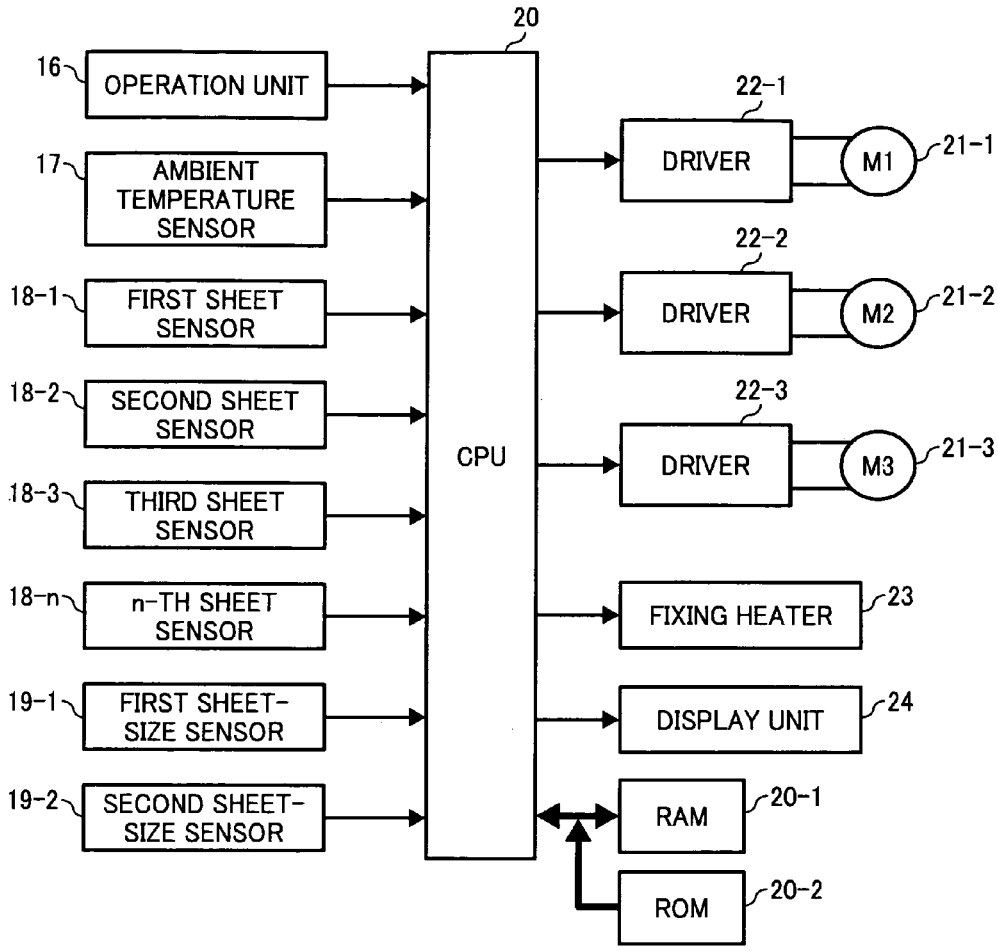
FIG. 2 is a block diagram of a relevant part of a sheet-conveying control system in the image forming apparatus in FIG. 1.

FIG. 2 is a block diagram of a relevant part of a sheet-conveying control system in the image forming apparatus 1. The number of sheet sensors (a sheet sensing device) 18, driving motors 21, and sheet-size sensors 19 shown in FIG. 2 changes according to a design condition. They are generally indicated as the appropriate number in FIG. 2. The sheet-conveying control system includes an operation unit 16, an ambient temperature sensor 17, first to n-th sheet sensors 18-1, 18-2, 18-3, . . . , and **18-*n*, first and second sheet-size sensors 19-1 and 19-2, a central processing unit (CPU) 20, a random access memory (RAM) 20-1, a read only memory (ROM) 20-2, various motors M1, M2, M3, . . . (21-1, 21-2, 21-3) such as a motor for driving the photosensitive drums 2Y, 2M, 2C, and 2K, a motor for driving the intermediate transfer belt 2-1, a motor for stirring developers in a developing unit, and a motor for driving fixing rollers in the fixing unit 4, drivers 22-1, 22-2, and 22-3 for the motors, a fixing heater 23, and a display unit 24. The CPU 20 executes a program stored in the ROM 20-2 by using the RAM 20-1 as a work area. At this time, a control condition is sent from the operation unit 16, the ambient temperature sensor 17, the sheet sensors 18-1, 18-2, 18-3, . . . , and 18-*n*, and the sheet-size sensors 19-1 and 19-2. The motors M1, M2, M3, . . . (21-1, 21-2, and 21-3), the fixing heater 23, and the display unit 24 are controlled based on the control condition. As shown in FIG. 1, ten sheet sensors 18-1 to 18-10** are indicated in this example.

Figure 3:
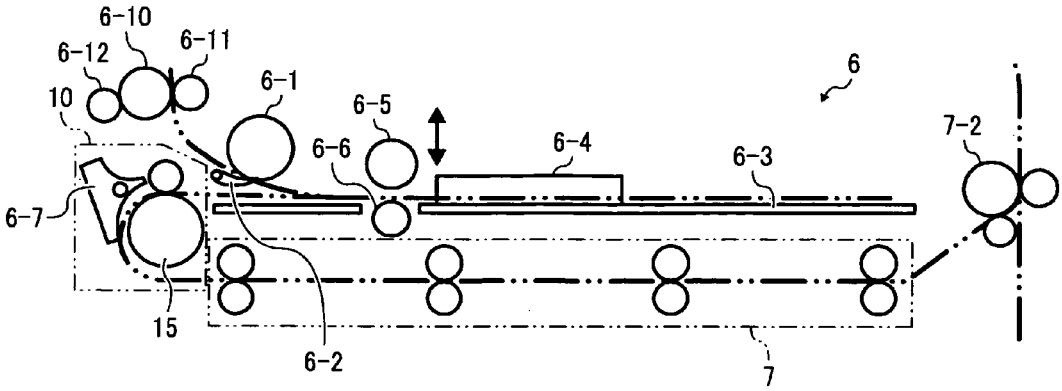
FIG. 3 is a schematic diagram of a relevant part of a reversing unit and its periphery in FIG. 1.

FIG. 3 is a schematic diagram of a relevant part of the reversing unit 6 and its periphery. A sheet P onto which an image is transferred and fixed is conveyed to the reversing unit 6. The sheet P is sent to a reversing table 6-3 by a pair of a reversing inlet roller 6-1 and a reversing conveyance claw 6-2. A pair of jogger fences 6-4 for adjusting a position or an orientation of a sheet are mounted on the reversing table 6-3. The sheet P conveyed to the reversing table 6-3 is aligned in a direction vertical to its conveying direction by jogging operations by the jogger fences 6-4 that are on standby keeping a width therebetween wider than a width of the sheet P for receiving the sheet P, and is moved to a position to guide the sheet P. A reversing driven roller 6-5 set apart above the reversing unit 6 descends toward the sheet P in a state where the sheet P is guided by the jogger fences 6-4, and makes the sheet P come into close contact with a reversing driving roller 6-6 that rotates in a direction opposite to the reversing driven roller 6-5. Thus, the sheet P changes its conveying direction (a trailing edge of the sheet P turns to a leading edge of the sheet P), and is conveyed to the sheet turning unit 10 (the turn roller 15). Then, the reversing driven roller 6-5 ascends to the original position so that the close contact between the sheet P and the reversing driving roller 6-6 is released. When a branching claw 6-7 rotates clockwise, the sheet P is conveyed upward, and a reverse discharging roller 6-12 discharges the sheet P that is reversed by the reversing driven roller 6-5 and the reversing driving roller 6-6 outside the image forming apparatus 1 without conveying it to the double-sided sheet feeding unit 7.

When an image is formed on one side of a sheet, as shown in FIG. 3, the branching claw 6-7 rotates clockwise to close the conveying path toward the double-sided sheet feeding unit 7 and to open the conveying path toward the sheet discharging unit 8. Thus, the sheet P is reversed (a leading edge of the sheet P turns to a trailing edge of the sheet P) and is conveyed by the turn roller 15 and the reverse discharging roller 6-12 to the sheet discharging unit 8 to be discharged therefrom with a side thereof on which an image is formed downward.

Meanwhile, when an image is formed on both sides of a sheet, the branching claw 6-7 rotates counterclockwise to close the conveying path toward the sheet discharging unit 8 and to open the conveying path toward the double-sided sheet feeding unit 7. Thus, the sheet P is conveyed by the turn roller 15 to the double-sided sheet feeding unit 7. The reversing driven roller 6-5 ascends to the original position and the close contact between the sheet P and the reversing driving roller 6-6 is released. The sheet P is conveyed through the double-sided sheet feeding unit 7 to relay rollers 7-2 and is fed to the image forming unit 2 again.

During the processing, after the sheet P is sent to the reversing table 6-3 by the pair of reversing inlet roller 6-1 and reversing conveyance claw 6-2 and temporarily stops on the reversing table 6-3, when the sheet P is conveyed to the turn roller 15, the sheet P is sharply turned by 180 degrees by the turn roller 15. At this time, a jam may occur because of a shift of a positional relation upon controlling conveying timing. In other words, a distance between conveyed sheets P is controlled to be constant after the pair of registration rollers (hereinafter, "registration rollers") 12. Therefore, when the sheet P fixed in the fixing unit 4 reaches the sheet turning unit 10 earlier, the sheet P temporarily stops. Thus, it takes a longer time until the sheet P is sharply turned after the image is fixed to the sheet P in the fixing unit 4, so that a state of the sheet P may change, which results in jamming.

The sheet with the image fixed thereto in the fixing unit 4 is jammed with the highest possibility at the sheet turning unit 10 at which the sheet is sharply turned. The possibility of jamming depends on a state of a sheet (curling or deformation), a temperature of a sheet, a radius of curvature of the sheet turning unit 10, and a three-dimensional shape of a conveyance guide in the sheet turning unit 10. As shown in FIG. 1, the sheet turning unit 10 that includes the turn roller 15 through which a sheet P reversed in the reversing unit 6 is conveyed to the double-sided sheet feeding unit 7 is referred to as a sharp turn unit. To reduce the possibility of jamming, variation in time to convey the sheet P from the fixing unit 4 to the sheet turning unit 10 is reduced or the sheet P is set in a state in which a jam is unlikely to occur, for example, curling or deformation is prevented from occurring or is hard to occur.

Figure 4:
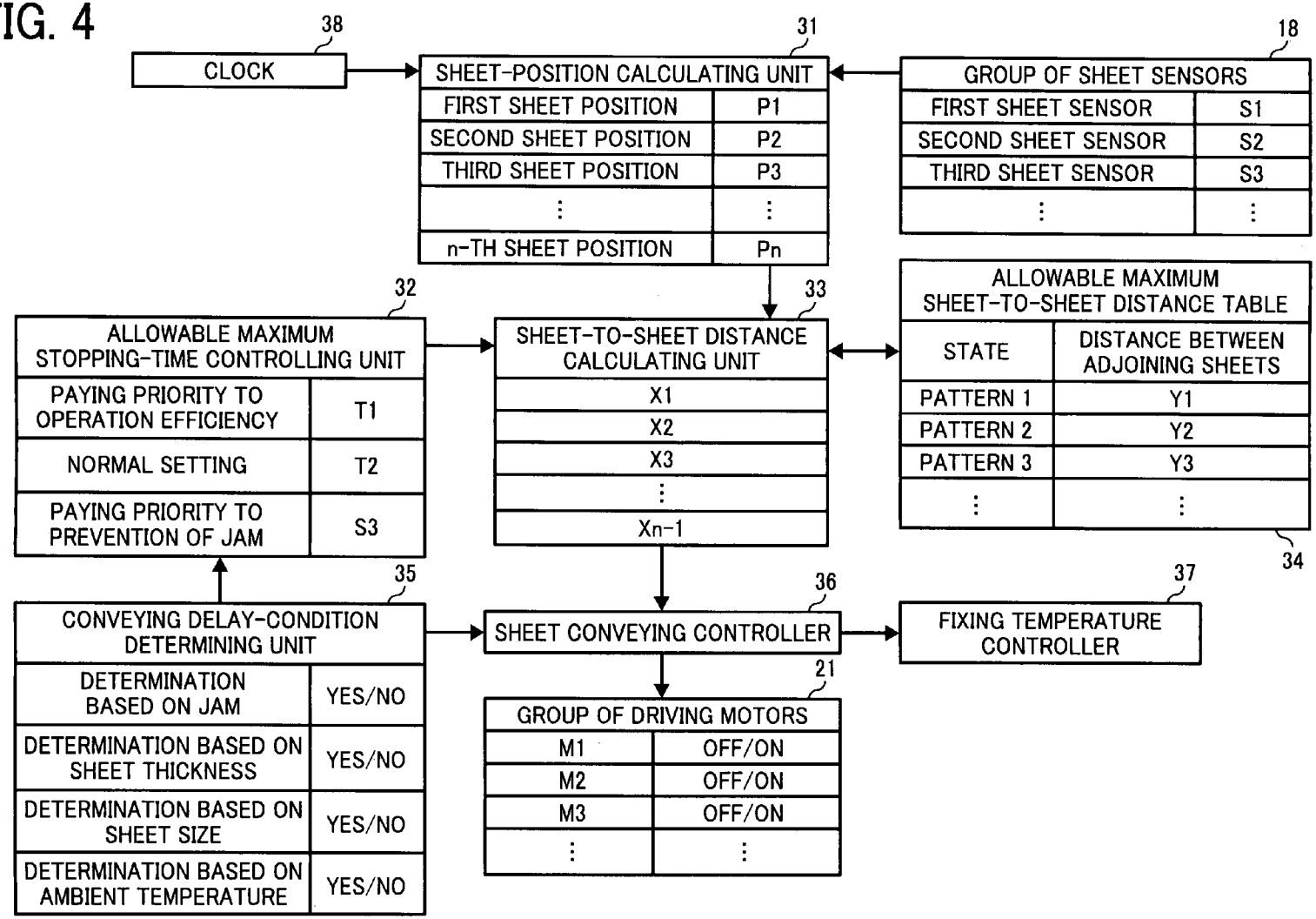
FIG. 4 is a schematic diagram for explaining a relevant function of a conveying system.

FIG. 4 is a schematic diagram for explaining a relevant function of a conveying system.

The conveying system includes a sheet-position calculating unit 31 that determines a position of a sheet, a group of sheet sensors 18, an allowable maximum stopping-time controlling unit 32, a sheet-to-sheet distance calculating unit 33, an allowable maximum sheet-to-sheet distance table 34, a conveying delay-condition determining unit 35, a sheet conveying controller 36, a group of the driving motors 21, and a fixing temperature controller 37. A signal from a clock 38 is sent to the sheet-position calculating unit 31.

The sheet-position calculating unit 31 calculates a current position of a sheet based on data on sheet-transfer speed, information from the sheet sensors 18, and information from the clock 38. The sheet-position calculating unit 31 stores therein, in advance, the data on sheet-transfer speed. The sheet sensors 18 that are mounted on a sheet conveying path sense a presence or absence of a sheet. The sheet-to-sheet distance calculating unit 33 calculates a distance between sheets based on the calculated value, and delays time for a sheet to reach the sheet turning unit 10 within a range that an allowable maximum distance between sheets that is obtained from the allowable maximum sheet-to-sheet distance table 34 is secured. The allowable maximum sheet-to-sheet distance table 34 is prepared as data in advance and stores therein the allowable maximum value between sheets for each sheet in a job. Such a delay can be caused by conveyance delay control performed by a conveyance delay system, i.e., a series of units that perform the conveyance delay control. Time can be delayed at a predetermined single site or a plurality of predetermined sites before a sheet is fixed as the method of delaying time. The sites can be optimized depending on a size of a sheet in the method. Thus, when a state of an image forming system is monitored based on a current job and a position of each sheet, and a sheet is estimated to temporarily stop at a point between the fixing unit 4 and the sheet turning unit 10, an operation of feeding sheets is delayed or a sheet is temporarily stopped at a predetermined position before the fixing unit 4. When the sheet is stopped before reaching the registration rollers 12, the sheet is stopped before sheet sag is formed at the registration rollers 12 (a state in which no sheet sag is formed), and the sheet before passing the sheet turning unit 10 is prevented from receiving additional loads.

An allowable maximum distance between sheets that is needed for each sheet in a job for each mode in controlling sheet conveyance is determined based on previously-stored data with regard to a distance between sheets in the allowable maximum sheet-to-sheet distance table 34. Distances between sheets are calculated based on the data stored in the allowable maximum sheet-to-sheet distance table 34 and position of the sheets calculated by the sheet-position calculating unit 31 based on actual sensing of the sheets by the sheet sensors 18 and time calculated by the clock 38. The sheet conveying controller 36 controls sheet conveyance based on the calculated values.

Time limits in which each of sheets reaches the sheet turning unit 10 are stored in the allowable maximum sheet-to-sheet distance table 34. An allowable maximum stopping time in which a sheet can stop can be calculated based on values in the allowable maximum sheet-to-sheet distance table 34 that are calculated based on a sheet stopping pattern and data on a distance between a sheet and the preceding sheet. The allowable maximum stopping time can be controlled by the allowable maximum stopping-time controlling unit 32. In normal setting, the allowable maximum stopping time is calculated based on values in the allowable maximum sheet-to-sheet distance table 34. When setting is performed by paying priority to operation efficiency, the allowable maximum stopping time is set shorter, thereby efficiently increasing image forming speed. The shorter setting is suitable for sheets that are good in a sheet conveying quality. Furthermore, in a jam preventing setting, the allowable maximum stopping time is set longer, so that a jam tends to occur with less possibility although an efficiency of image forming speed (operation efficiency) is decreased. The longer setting is suitable for sheets that are bad in a sheet conveying quality.

The conveying delay-condition determining unit 35 automatically determines whether the sheet conveying controller 36 performs a conveyance delay control based on a thickness, a size of a sheet, or jam occurrence. The conveying delay-condition determining unit 35 also controls the allowable maximum stopping time based on each of the above conditions, thereby selecting a more suitable conveying condition.

Described below is a first example of interleaf control according to the embodiment with respect to two large-sized sheets. The number of sheets that are first conveyed to the sheet conveying path of the image forming apparatus is referred to as "Interleaf number". For example, as for n-sheet interleaf control, the n sheets P are first conveyed to the sheet conveying path and, from the $n+1^{th}$ sheet, sheets are alternately fed from the sheet feeding unit and the double-sided sheet feeding unit (alternate feeding). That is, as for two-sheet interleaf control, two sheets are first conveyed. After the first sheet is conveyed to the image forming unit to form an image on a second side (a back side) of the sheet, a third sheet is fed from the sheet feeding unit. After the second sheet is fed to the image forming unit, a fourth sheet is fed from the sheet feeding unit. Thus, the alternate feeding of sheets from the sheet feeding unit 3 and the double-sided sheet feeding unit 7 is repeated. An image is formed on a second side of a sheet conveyed from the double-sided sheet feeding unit 7 and an image is formed on a first side (a front side) of a sheet conveyed from the sheet feeding unit 3, respectively. As for three-sheet interleaf control, three sheets are first conveyed. After the first sheet is conveyed to the image forming unit to form an image a second side of the first sheet, a fourth sheet is fed from the sheet feeding unit 3. After the second sheet is fed to the image forming unit, a fifth sheet is fed from the sheet feeding unit 3. Thus, the alternate feeding of sheets from the sheet feeding unit 3 and the double-sided sheet feeding unit 7 is repeated. An image is formed on a second side of a sheet conveyed from the double-sided sheet feeding unit 7, and an image is formed on a first side of a sheet conveyed from the sheet feeding unit 3, respectively. Thereafter, an operation of inserting a sheet between sheets that are consecutively fed from the sheet feeding unit is repeated.

Operations of two-large-sized-sheet interleaf control are explained referring to FIGS. 5 to 9. To distinguish a surface on which an image is formed from a surface on which an image is not formed, black protrusions are drawn on the surface on which an image is formed to indicate that toners are adhered to the surface in the following description. The image forming apparatus 1 is the same as that in FIG. 1, so that the same reference numerals are given to the same components of the image forming apparatus 1 shown in FIG. 1, and the explanation of the same components is omitted.

Figure 5:
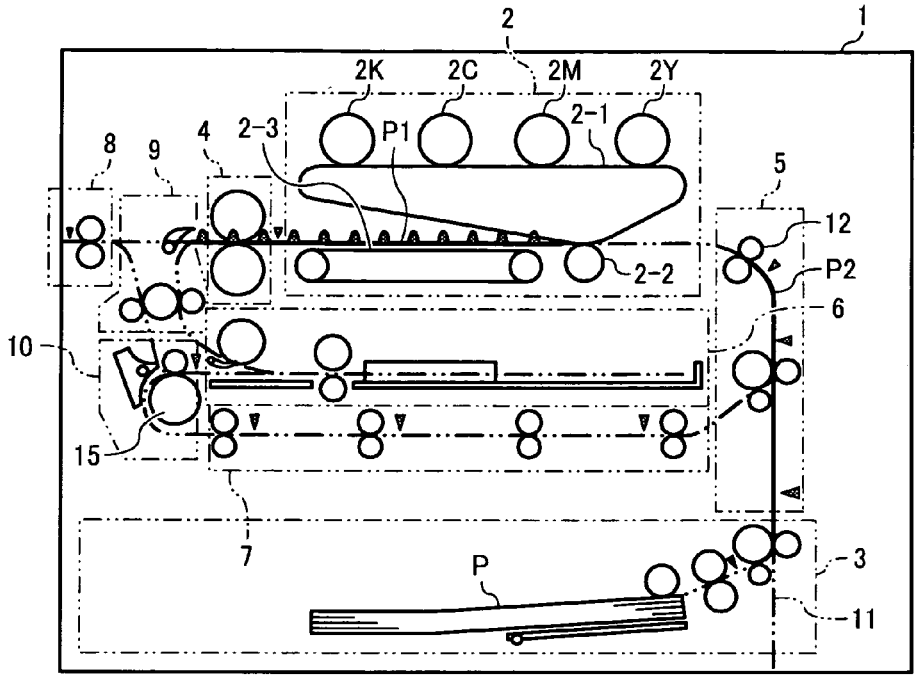
FIG. 5 is a schematic diagram for explaining operations of performing two-large-sized sheet interleaf control in a first example in which first two sheets are located in a conveying path of the image forming apparatus.

First two sheets are located on the conveying path of the image forming apparatus 1 in FIG. 5. An image is formed on a first side of a first sheet P1, and a second sheet P2 that is fed from the sheet feeding unit 3 temporarily stops at the registration rollers 12. A leading edge of the sheet P1 enters the fixing unit 4 in which the image formed on the first side is fixed, and a trailing edge of the sheet P1 passes through a nip between the intermediate transfer belt 2-1 and the secondary transfer roller 2-2, which indicates that the image has been transferred onto the first side of the sheet P1.

Figure 6:
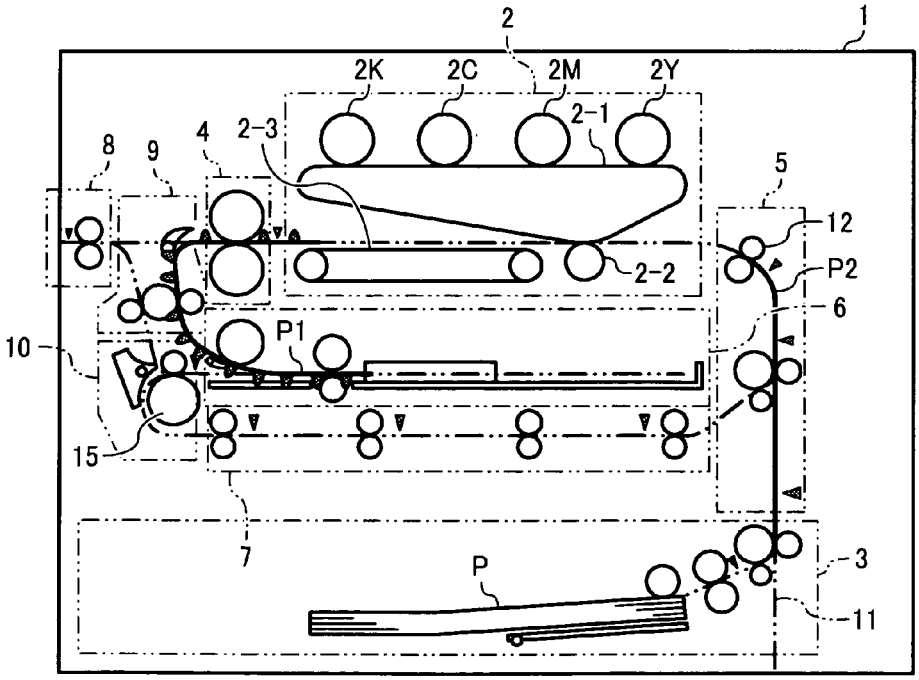
FIG. 6 is a schematic diagram representing a state in which a leading edge of a first sheet moves from a reversing inlet roller to a reversing driving roller of the reversing unit and a trailing edge of the first sheet is located at a fixing unit.

The leading edge of the sheet P1 moves from the reversing inlet roller 6-1 to the reversing driving roller 6-6, and the trailing edge of the sheet P1 is located at the fixing unit 4 in FIG. 6. Under this condition, the sheet P2 is being stopped at the registration rollers 12. The large-sized sheet is long to the extent that when a leading edge of the sheet is located at the fixing unit 4, a trailing edge of the sheet is located at the secondary transfer roller 2-2 (a transfer unit).

Figure 7:
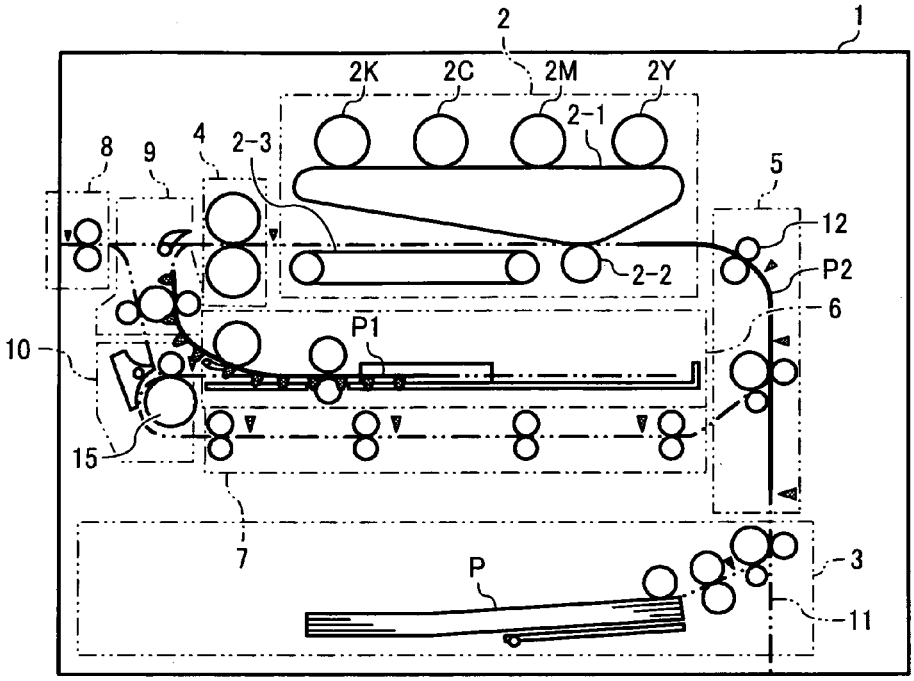
FIG. 7 is a schematic diagram representing a state in which the first sheet is conveyed to a reversing table, and a second sheet moves to an image forming position after passing through registration rollers.

Following the state of FIG. 6, the sheet P1 is conveyed to the reversing table 6-3, and the sheet P2 is entering the image forming unit 2 through the registration rollers 12 in FIG. 7. Under this condition, the trailing edge of the sheet P1 has passed through the fixing unit 4, so that an image formed on the first side of the sheet P1 has been already fixed, and the sheet P1 is being conveyed to the reversing table 6-3 in which the sheet P1 is reversed.

Figure 8:
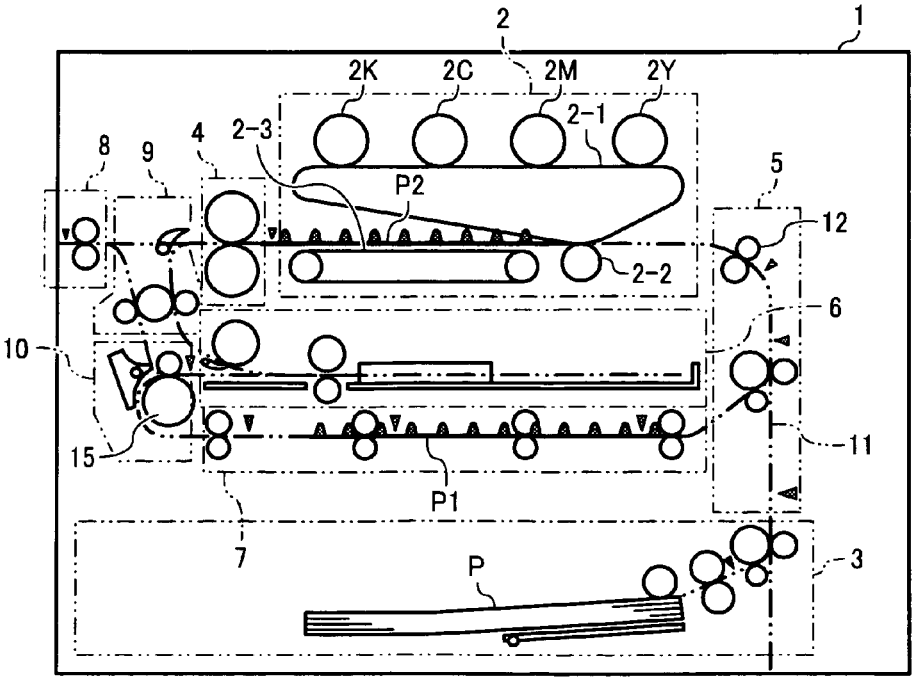
FIG. 8 is a schematic diagram representing a state in which the first sheet once placed on the reversing table is reversed, passes through a sheet turning unit, and temporarily stops at a double-sided sheet feeding unit until the first sheet starts to be conveyed to an image forming unit.
Figure 9:
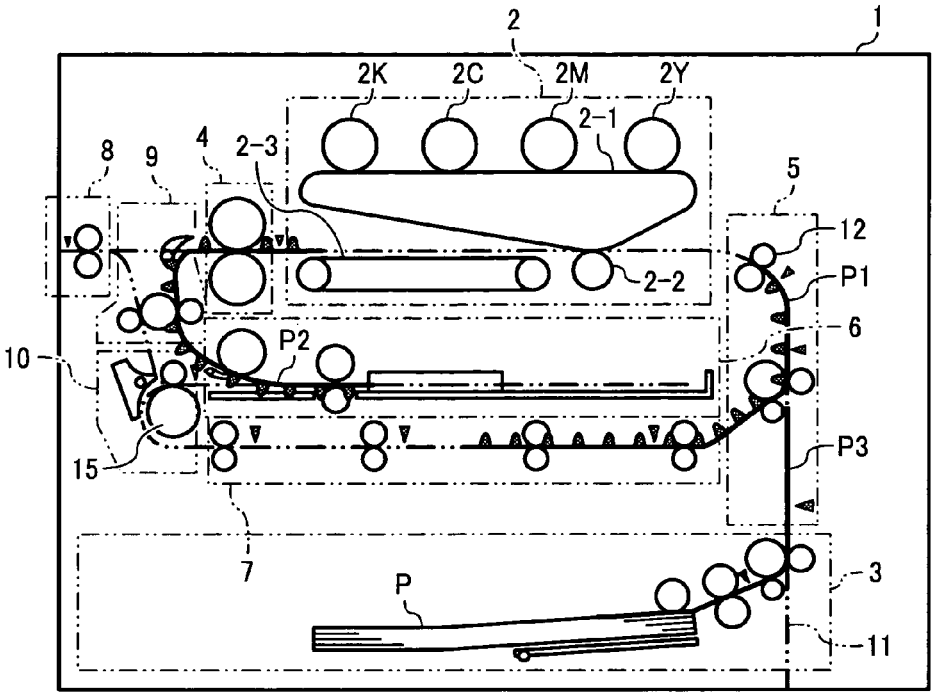
FIG. 9 is a schematic diagram representing a state in which an image is formed on a first side (a front side) of the second sheet, and is conveyed through the fixing unit to the reversing unit.

The sheet P1 once placed on the reversing table 6-3 is immediately reversed along with rotation of the reversing driving roller 6-6. As shown in FIG. 8, the sheet P1 is conveyed through the sheet turning unit 10 to the double-sided sheet feeding unit 7 and temporarily stops in the double-sided sheet feeding unit 7 until the sheet P1 starts to be conveyed to the image forming unit 2. During this period, an image is formed on a first side of the sheet P2, and the sheet P2 temporarily stops immediately before the fixing unit 4. When the stopping condition of the sheet P2 is released, as shown in FIG. 9, the sheet P2 is conveyed through the fixing unit 4 to the reversing unit 6. With a procedure of the conveyance, an image to be formed on a second side of the sheet P1 is formed on the intermediate transfer belt 2-1 in the image forming unit 2. Along with this, the sheet P1 is conveyed from the double-sided sheet feeding unit 7, and the image is formed on the second side of the sheet P1.

At this time, a third sheet P3 is conveyed from the sheet feeding unit 3 to the registration rollers 12 where the sheet P3 temporarily stops. Then, the first sheet P1 with the image formed and fixed on the second side is sent to the reversing unit 6. The sheet P1 with the images formed on both sides is conveyed to the reversed sheet discharging path unit 9 by rotation of the reversing driving roller 6-6 and is discharged through the sheet discharging unit 8 to a sheet discharging tray.

During this period, an image is transferred onto the sheet P3 conveyed to the image forming unit 2, and the sheet P2 is sent from the double-sided sheet feeding unit 7 behind the sheet P3 and waits at the registration rollers 12 for image formation on a first side of the sheet P3 to finish. Thereafter, the same operations as those to the sheet P1 are repeated, so that images are formed on the following sheets through the alternate feeding.

Because two sheets are first sent from the sheet feeding unit 3, the last two sheets are not subjected to the alternate feeding and finally remain in the sheet conveying path. Under this condition, an image is formed on second sides of the second last sheet and the last sheet in this order, and the last two sheets are sent through the reversing unit 6 to the sheet discharging unit 8 to be discharged therefrom.

According to the first example, after first two sheets are sent from the sheet feeding unit 3, the sheet P1 is conveyed to the double-sided sheet feeding unit 7 without stopping (waiting) at the reversing unit 6 and temporarily stops at the double-sided sheet feeding unit 7. Therefore, it is prevented that temperature of the sheet P1 heated at the fixing unit 4 decreases while the sheet P1 stops at the reversing unit 6, and temperature of the sheet P1 is different from temperature of a sheet in the alternate feeding at the time of passing through the sheet turning unit 10. This makes it possible to reduce jamming.

Meanwhile, as shown in FIG. 8, the second sheet P2 temporarily stops immediately before the fixing unit 4. However, when the sheet P2 cannot temporarily stop on an upstream side of the fixing unit 4 or when it is not determined whether the sheet P2 temporarily stops on a downstream side of the fixing unit 4, the sheet P2 passes through the fixing unit 4 without temporarily stopping on the upstream side of the fixing unit 4. However, if a sheet temporarily stops at the reversing unit 6, the sheet begins changing in stiffness or curling while the sheet is temporarily stops due to change in moisture or heat that the sheet has after the image is fixed thereto. A curled state of the sheet may change in time or the sheet may become stiff after being cooled. When the sheet passes along the turn roller 15 (a curve unit) in such a state, there is a higher possibility of causing a jam.

Figure 37:
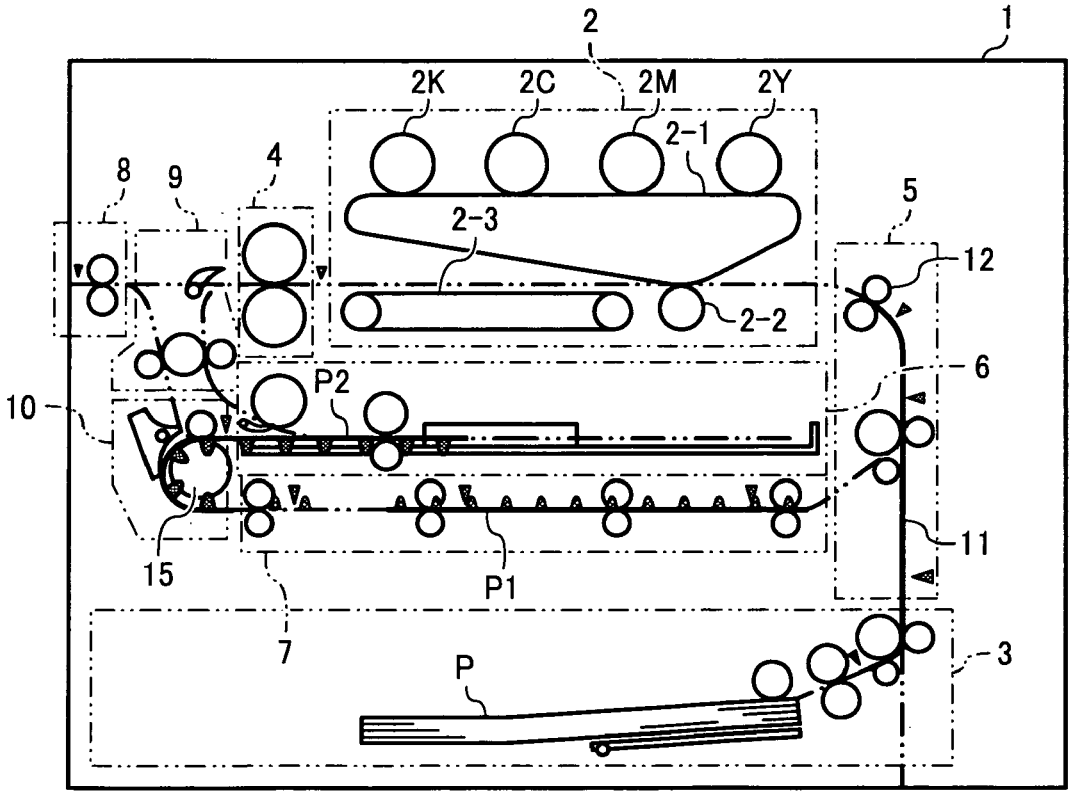
FIG. 37 is a schematic diagram representing a state in which a second sheet temporarily stops immediately after a leading edge of the second sheet passes the turn roller, which is a stopping state different from that in FIG. 8.

Accordingly, as shown in FIG. 37, a sheet is kept in a state in which at least a leading edge of the sheet has passed the turn roller 15, thereby preventing jamming. Specifically, if the sheet is folded due to the increase of curling, the sheet may jam when passing the turn roller 15, and if the sheet is cooled and becomes stiff, the sheet becomes difficult to pass the turn roller 15. Before causing such conditions, at least a leading edge of the sheet is being passed along the turn roller 15. Thus, the rest of the sheet is also continuously conveyed, thereby lowering a jam occurrence rate. In FIG. 37, an image is formed on each of first sides of the sheets P1 and P2.

The conventional interleaf control is explained below as a first comparative example referring to FIGS. 10 to 14.

Figure 10:
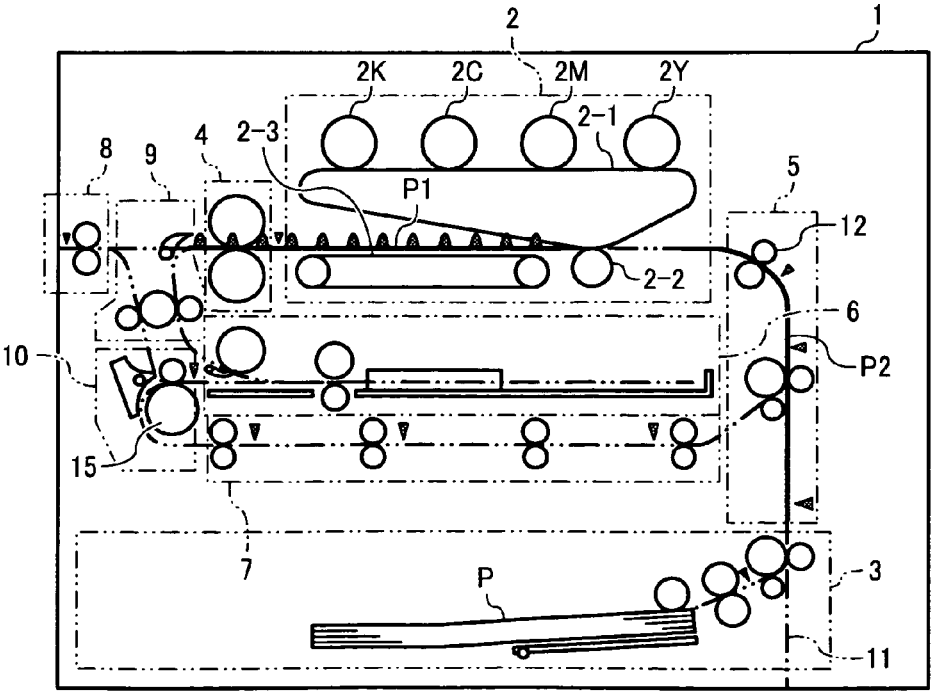
FIG. 10 is a schematic diagram representing a state in which first two sheets are located in the conveying path of the image forming apparatus in a first comparative example.

The first comparative example is a case of the two-large-sized-sheet interleaf control as in the first example. As shown in FIG. 10, first two large-sized sheets are located in the conveying path of the image forming apparatus 1. An image is formed on a first side of a first sheet P1, and a second sheet P2 fed from the sheet feeding unit 3 passes the registration rollers 12 and is located immediately before an image transfer. A leading edge of the sheet P1 enters the fixing unit 4 in which the image formed on the first side of the sheet P1 is fixed, and a trailing edge of the sheet P1 has passed through a nip between the intermediate transfer belt 2-1 and the secondary transfer roller 2-2, so that the image has already been transferred onto the sheet P1.

Figure 11:
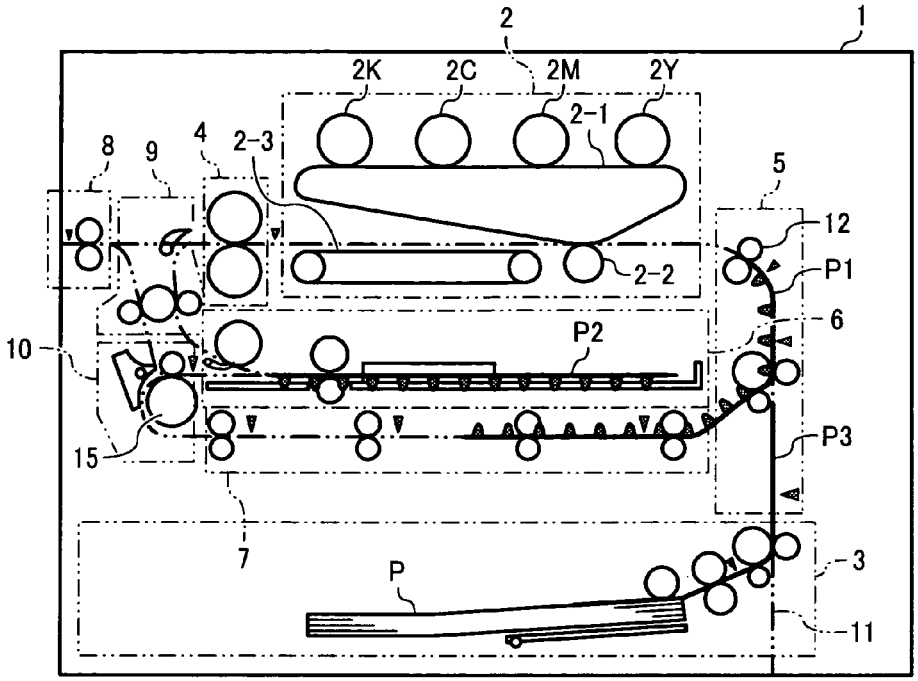
FIG. 11 is a schematic diagram representing a state in which a leading edge of a first sheet that is conveyed from the double-sided sheet feeding unit stops at a nip between registration rollers, and a second sheet temporarily stops on a reversing tray of the reversing unit.
Figure 12:
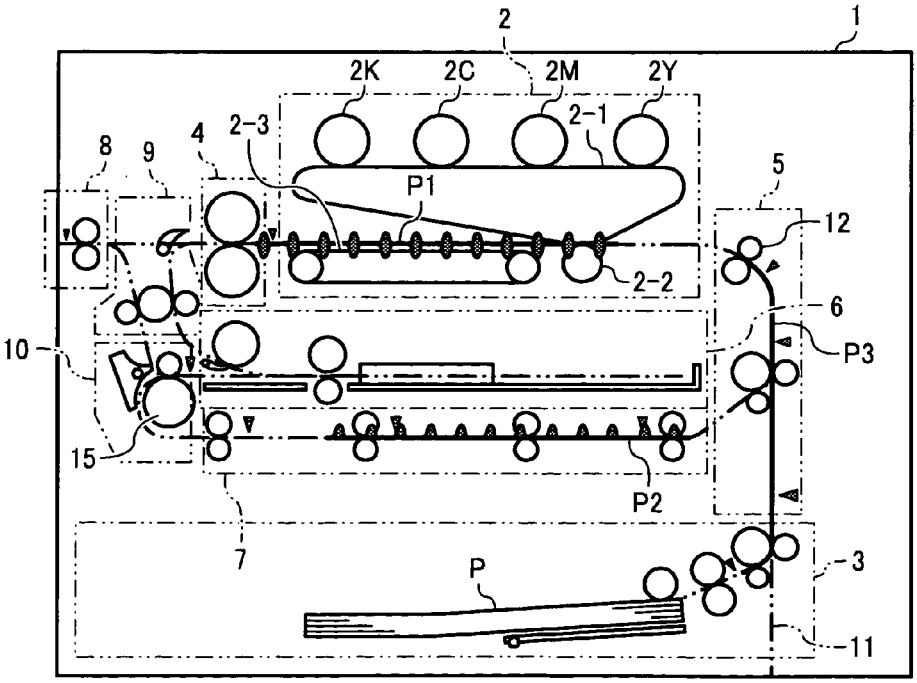
FIG. 12 is a schematic diagram representing a state in which the first sheet is conveyed to an image forming position and an image is formed on a second side (a back side) of the first sheet.

As shown in FIG. 11, the sheet P1 is conveyed from the double-sided sheet feeding unit 7 so that the leading edge of the sheet P1 stops at a nip between the registration rollers 12, and the sheet P2 temporarily stops at the reversing driving roller 6-6. In FIG. 11, an image is formed and fixed on each of the first sides of the sheets P1 and P2. Following the state in FIG. 11, as shown in FIG. 12, the sheet P1 is conveyed from the registration rollers 12, and an image is formed on a second side of the sheet P1. Along with this operation, a third sheet P3 is conveyed from the sheet feeding unit 3 and temporarily stops at the registration rollers 12. The sheet P2 temporarily stops at the double-sided sheet feeding unit 7.

Figure 13:
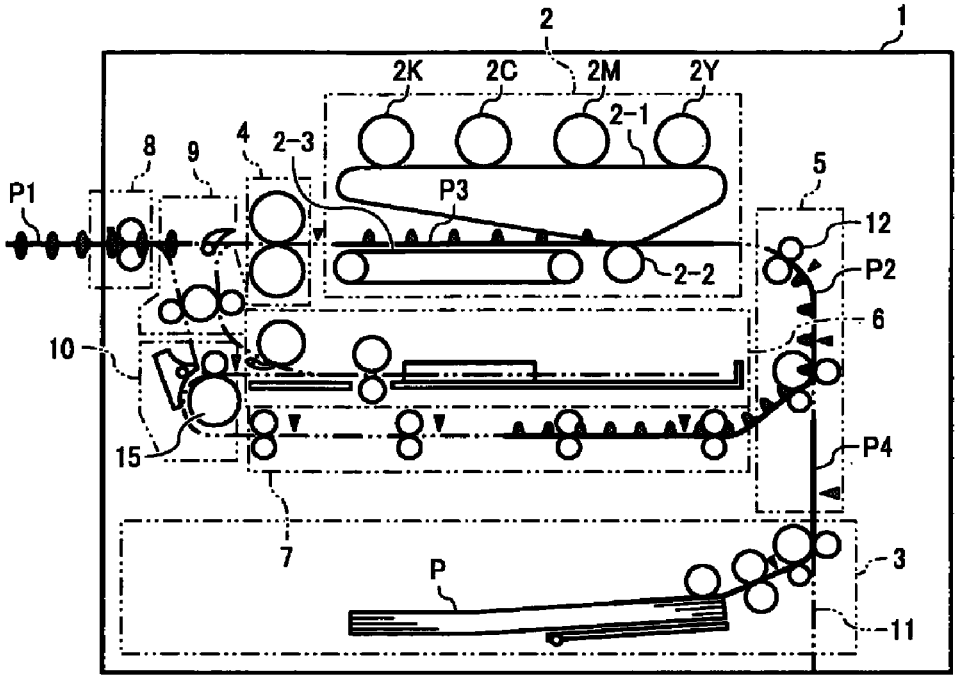
FIG. 13 is a schematic diagram representing a state in which an image is formed on a first side of a third sheet, the second sheet is conveyed from the double-sided sheet feeding unit to the registration rollers, and the second sheet temporarily stops at the registration rollers.

After the images are formed on both sides of the sheet P1, the sheet P1 is conveyed through the fixing unit 4 to the sheet discharging unit 8 with the first side facing downward (face-down) to be discharged therefrom. Along with this operation, as shown in FIG. 13, an image is formed on a first side of the sheet P3, and the sheet P2 is conveyed from the double-sided sheet feeding unit 7 to the registration rollers 12 and temporarily stops at the registration rollers 12. The alternate feeding of sheets is performed from the sheet feeding unit 3 and the double-sided sheet feeding unit 7 based on this condition. An image is formed on a first side of a sheet conveyed from the sheet feeding unit 3, and an image is formed on a second side of a sheet conveyed from the double-sided sheet feeding unit 7, respectively.

Figure 14:
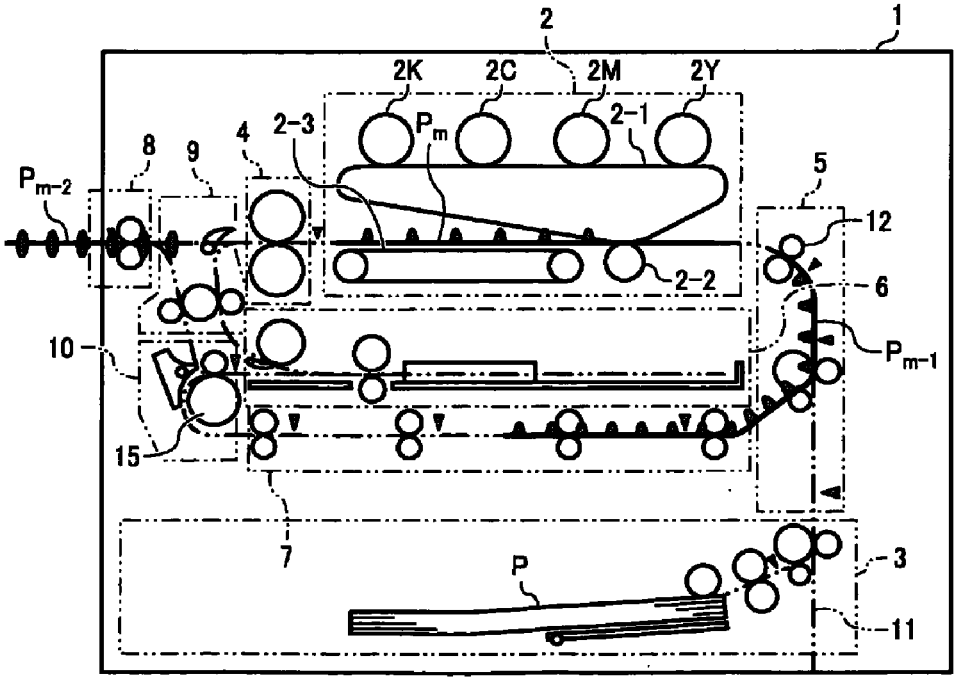
FIG. 14 is a schematic diagram representing a state in which the last two sheets remain on the conveying path.

The alternate feeding continues until the last two sheets Pm-1 and Pm. As shown in FIG. 14, when the last two sheets are conveyed, the sheet feeding unit 3 stops feeding sheets. The second last sheet Pm-1 temporarily stops at the registration rollers 12 until an image is formed on a first side of the last sheet Pm. When an image is formed on the first side of the last sheet Pm, and the last sheet Pm is conveyed to the fixing unit 4, the second last sheet Pm-1 is conveyed to the transfer unit in which an image is formed on a second side of the second last sheet Pm-1. The second last sheet Pm-1 is discharged through the fixing unit 4 and the sheet discharging unit 8 while the last sheet Pm is conveyed through the reversing unit 6 and the double-sided sheet feeding unit 7 to the transfer unit to form an image on its second side after receiving registration adjustment and skew correction at the registration rollers 12. After finishing transferring an image onto its second side, the last sheet Pm is conveyed to the sheet discharging unit 8 through the fixing unit 4 to be discharged therefrom.

In the first comparative example, as shown in FIG. 11, the sheet P2 waits at the reversing table 6-3 for the sheet P1 being conveyed. Therefore, instead of passing along the turn roller 15 continuously after heat is applied in the fixing unit 4, the sheet P2 temporarily stops at the reversing table 6-3 for a predetermined time and then passes along the turn roller 15. As a result, different from a case in which the sheet P2 is conveyed without stopping at the reversing table 6-3, the sheet P2 passes along the turn roller 15 after the sheet P2 is cooled. As shown in FIG. 11, the turn roller 15 has a small diameter (for example, ϕ about 40 millimeters) and a large curvature, so that if the state of a leading edge of a sheet changes, a jam is likely to occur.

When a sheet that temporarily stops in the reversing unit 6 passes along the turn roller 15 as in the first comparative example, temperature of the sheet decreases, and a temperature condition becomes different from that in the alternate feeding. Therefore, according to the embodiment, a sheet is prevented from temporarily stopping at the reversing unit 6 before the alternate feeding starts in the interleaf control as in the first example. If it is necessary to temporarily stop a sheet, the sheet is temporarily stopped at an upstream of the fixing unit 4 as shown in FIG. 8, and the time required for the sheet to pass the turn roller 15 after passing the fixing unit 4 is controlled to be approximately the same. A distance between sheets is different between a stopping state and an alternate feeding state. Accordingly, the sheet-to-sheet distance calculating unit 33 calculates a distance between sheets with reference to the allowable maximum sheet-to-sheet distance table 34 based on time and position information from the allowable maximum stopping-time controlling unit 32 and the sheet-position calculating unit 31, and outputs a calculated value to the sheet conveying controller 36. The sheet conveying controller 36 performs sheet conveyance control based on received information about the distance between sheets and information determined by the conveying delay condition determining unit 35, and controls the driving motors 21 for driving conveying rollers. The sheet conveyance in the interleaf control is controlled in this manner.

Two-middle-sized-sheet interleaf control is explained as a second example. The middle-sized sheet is long to the extent that when a leading edge of the sheet is located at the fixing unit 4, a trailing edge of the sheet completely gets out of the secondary transfer roller 2-2 (a transfer roller).

Operations of the two-middle-sized-sheet interleaf control are explained referring to FIGS. 15 to 18. The image forming apparatus 1 is the same as that in FIG. 1, so that the same reference numerals are given to the same components of the image forming apparatus 1, and the explanation of the same components is omitted.

Figure 15:
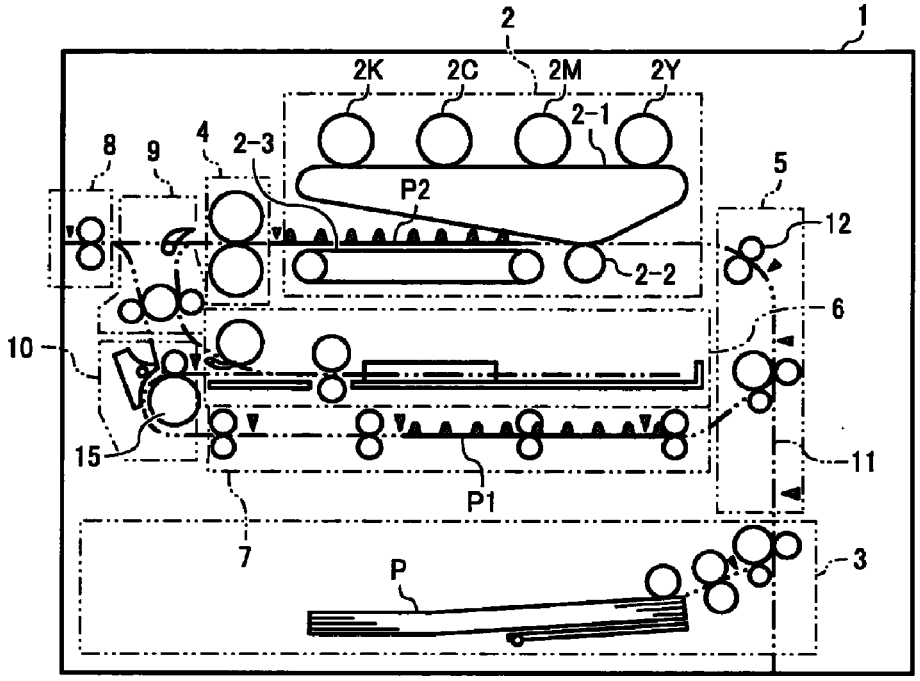
FIG. 15 is a schematic diagram representing a state in which first two sheets are located in the conveying path of the image forming apparatus in a second example.

First two sheets are located on the conveying path of the image forming apparatus 1 in FIG. 15. A first sheet P1 temporarily stops at the double-sided sheet feeding unit 7 after an image is formed on a first side thereof, and a second sheet P2 temporarily stops immediately before a leading edge of the sheet P2 reaches the fixing unit 4 after an image is formed on a first side thereof. Under this state, a trailing edge of the sheet P2 gets out of a nip between the intermediate transfer belt 2-1 and the secondary transfer roller 2-2.

Figure 16:
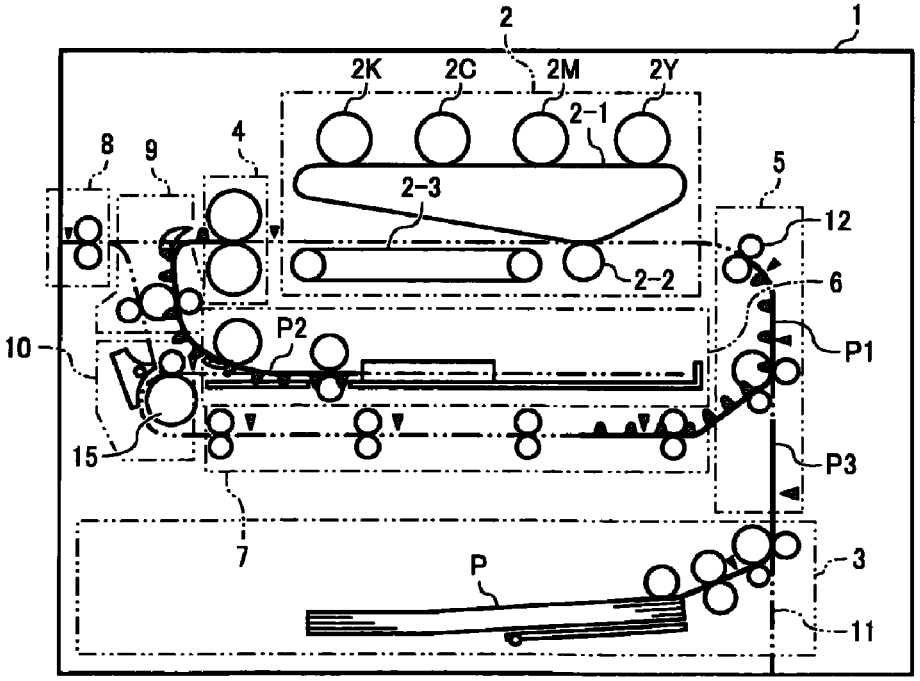
FIG. 16 is a schematic diagram representing a state in which a first sheet is conveyed to the registration rollers and temporarily stops at the registration rollers, and a second sheet is entering the reversing unit.
Figure 17:
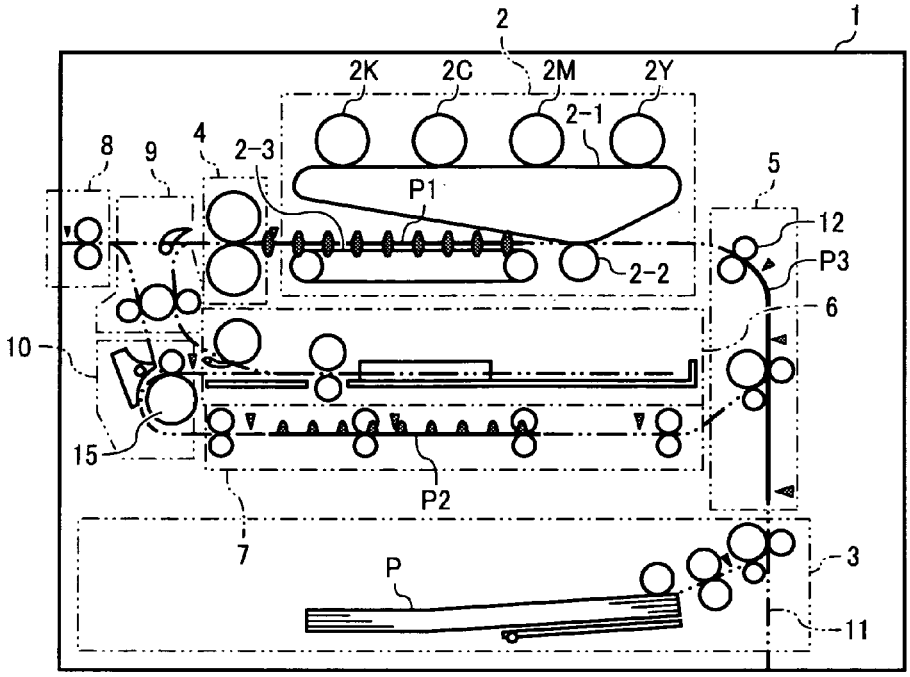
FIG. 17 is a schematic diagram representing a state in which the first sheet is conveyed to just before the fixing unit after an image is formed on a second side thereof, and a third sheet is conveyed to the registration rollers.

When sheet conveyance starts from the state shown in FIG. 15, the sheet P1 is conveyed to the registration rollers 12 and temporarily stops at the registration rollers 12 shown in FIG. 16. The sheet P2 enters the reversing unit 6. Then, as shown in FIG. 17, an image is formed on a second side of the sheet P1, and the sheet P1 is conveyed immediately before the fixing unit 4. A third sheet P3 is conveyed to the registration rollers 12 and stops to receive registration adjustment and skew correction. The sheet P2 is being conveyed in the double-sided sheet feeding unit 7. The alternate feeding starts from this state.

Figure 18:
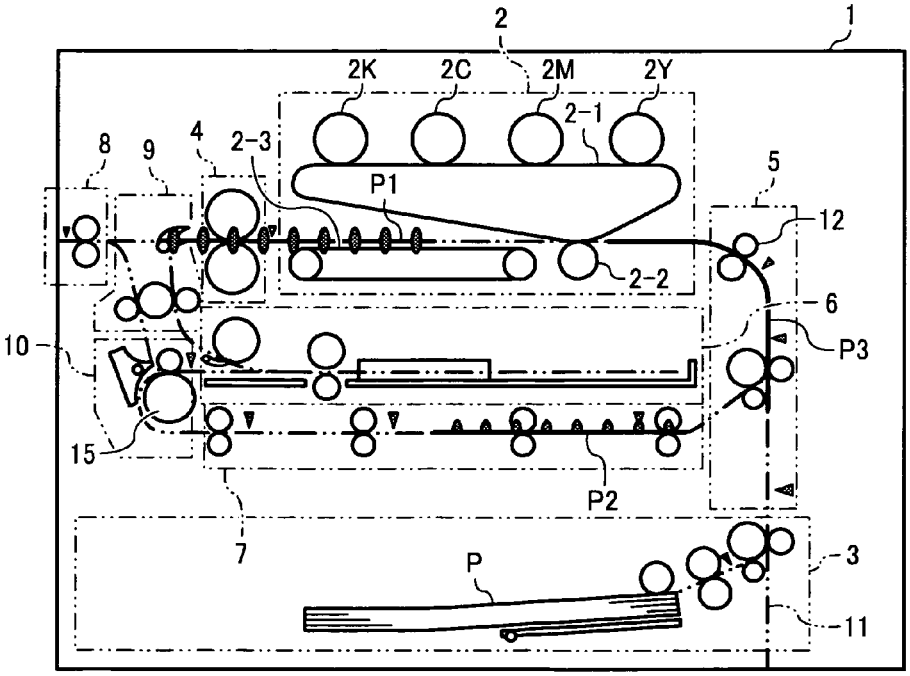
FIG. 18 is a schematic diagram representing a state of starting alternate feeding of sheets in which the first sheet with the images formed on both sides is on the conveying path extending from the fixing unit to a sheet discharging unit, the third sheet is conveyed to an image forming position from the registration rollers, and the second sheet temporarily stops at the double-sided sheet feeding unit.

Following the state in FIG. 17, images are formed on both sides of the sheet P1, and the sheet P1 is on the conveying path from the fixing unit 4 to the sheet discharging unit 8 in FIG. 18. The sheet P3 is conveyed from the registration rollers 12 to a position at which an image is formed. The sheet P2 temporarily stops at the double-sided sheet feeding unit 7 and waits for the sheet P1 to be discharged and for the sheet P3 to receive image forming processing. When an image is formed on a first side of the sheet P3, the sheet P2 is conveyed to the registration rollers 12. When image forming on the first side of the sheet P3 finishes, the sheet P2 is conveyed to the transfer unit to form an image on a second side of the sheet P2. Along with this operation, a fourth sheet P4 is sent from the sheet feeding unit 3. In this manner, the alternate feeding is performed and images are formed on both sides of sheets P.

As shown in FIG. 14 in the first comparative example, because first two sheets are sent from the sheet feeding unit 3, the second last sheet P and the last sheet P are not subjected to the alternate feeding and remain on the conveying path. Under this condition, an image is formed on second sides of the second last sheet P and the last sheet P in this order, and the sheets P are conveyed through the reversing unit 6 to the sheet discharging unit 8 to be discharged therefrom.

As shown in FIG. 15, in the second example, the sheet P2 temporarily stops before the fixing unit 4 but does not temporarily stop at the reversing unit 6. The sheet P2 is shorter than a distance between the transfer unit and the fixing unit 4, so that the sheet P2 temporarily stops without having any effect on image forming, and it is prevented that temperature of the sheet P2 decreases at the reversing unit 6. Therefore, it is prevented that temperature of the sheet P1 heated at the fixing unit 4 decreases while the sheet P1 temporarily stops at the reversing unit 6, and a temperature condition of the sheet when the sheet passes through the sheet turning unit 10 is different from that in the alternate feeding. This makes it possible to reduce jamming.

Three-small-sized-sheet interleaf control is explained as a third example. The small-sized sheet is long to the extent that two of them are accommodated in the double-sided sheet feeding unit 7.

Operations of the three-small-sized-sheet interleaf control are explained referring to FIGS. 19 to 30. The image forming apparatus 1 is the same as that in FIG. 1, so that the same reference numerals are given to the same components of the image forming apparatus 1, and the explanation of the same components is omitted.

Figure 19:
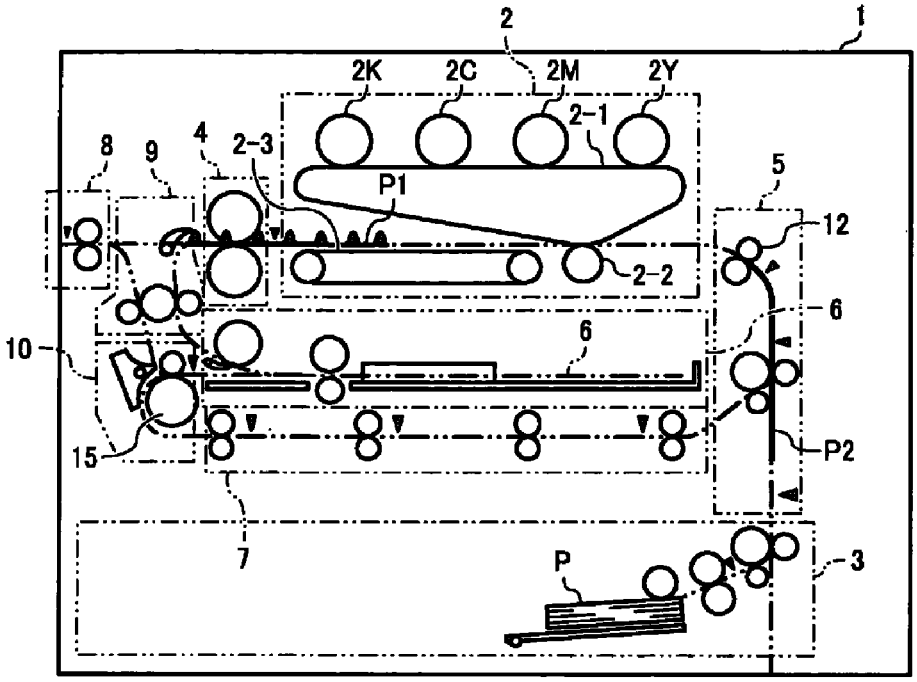
FIG. 19 is a schematic diagram representing a state in which first two sheets are located in the conveying path of the image forming apparatus in a third example.

First two sheets are located on the conveying path of the image forming apparatus 1 in FIG. 19. An image is formed on a first side of a first sheet P1, and a second sheet P2 is sent from a sheet feeding unit 3 and temporarily stops at the registration rollers 12. A leading edge of the sheet P1 enters the fixing unit 4 in which the image formed on the first side is fixed, and a trailing edge of the sheet P1 passes through a nip between the intermediate transfer belt 2-1 and the secondary transfer roller 2-2, which indicates that the sheet P1 is conveyed a predetermined distance after the image is transferred onto the first side of the sheet P1.

Figure 20:
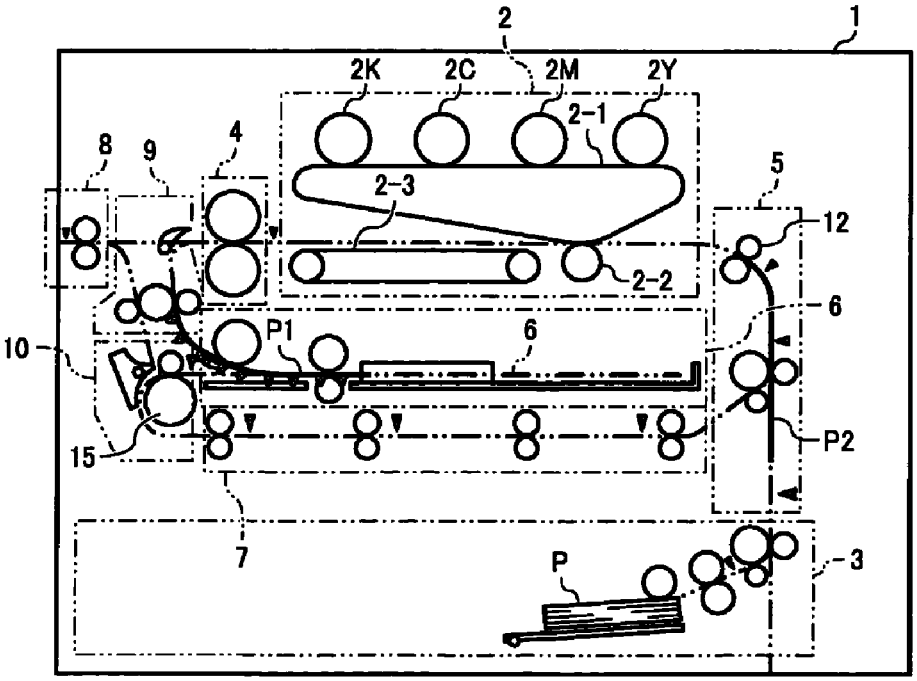
FIG. 20 is a schematic diagram representing a state in which a leading edge of a first sheet moves to the reversing driving roller and a trailing edge of the first sheet has just passed through a pair of conveying rollers.

As shown in FIG. 20, the leading edge of the sheet P1 moves from the reversing inlet roller 6-1 to the reversing driving roller 6-6, and a trailing edge of the sheet P1 gets out of a pair of conveying rollers 6-10 and 6-11, while the sheet P2 still stops at the registration rollers 12.

Figure 21:
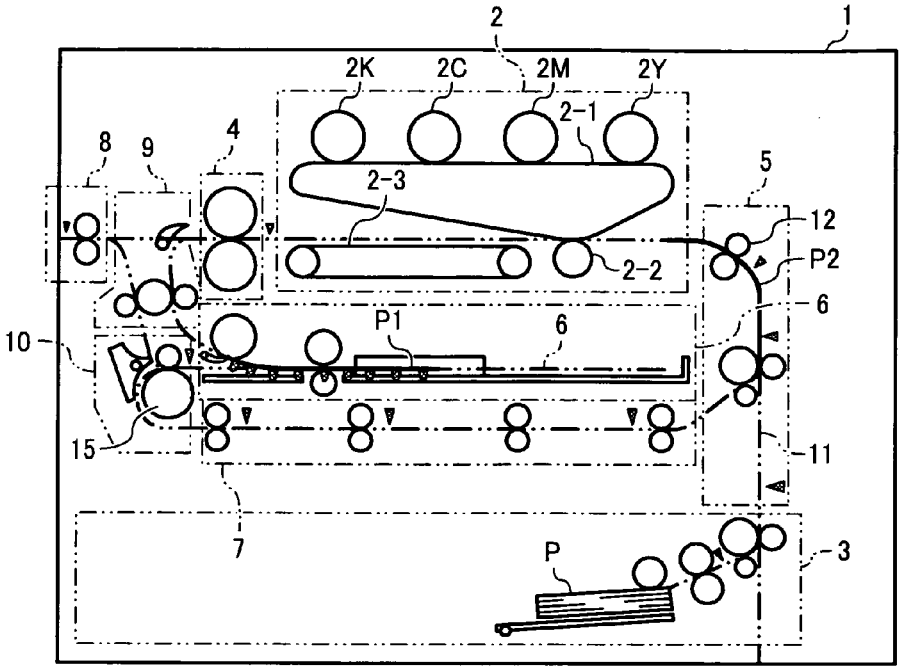
FIG. 21 is a schematic diagram representing a state in which the first sheet is conveyed to the reversing table, and a second sheet is entering the image forming position after passing through the registration rollers.
Figure 22:
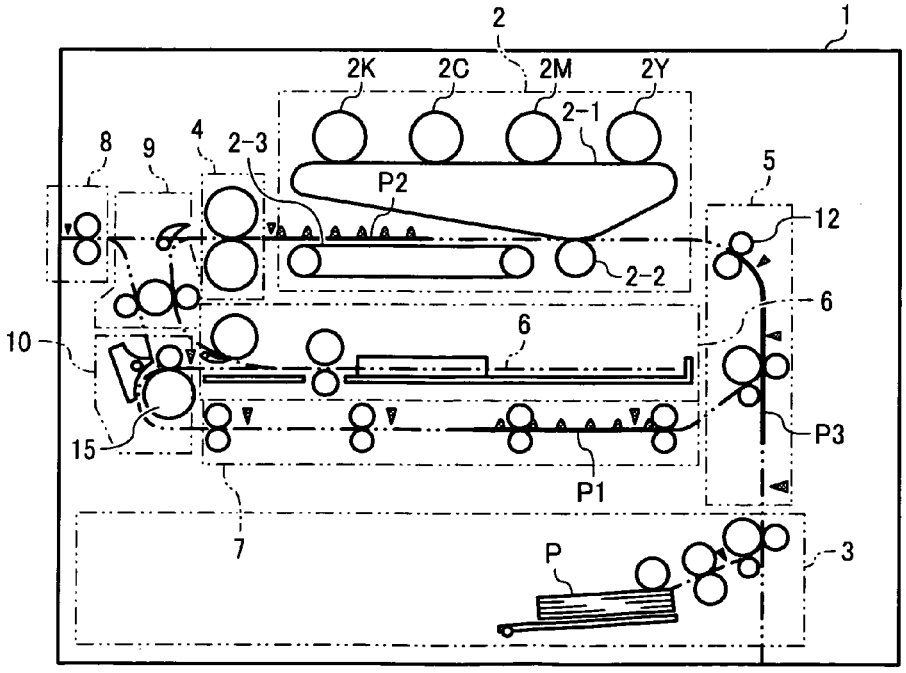
FIG. 22 is a schematic diagram representing a state in which the first sheet is reversed, conveyed through the sheet turning unit to the double-sided sheet feeding unit, and temporarily stops at the double-sided sheet feeding unit until the first sheet starts to be conveyed to the image forming unit.

Following the state in FIG. 20, as shown in FIG. 21, the sheet P1 is conveyed to the reversing table 6-3, and the sheet P2 passes through the registration rollers 12 to enter the image forming position. The sheet P1 once accommodated on the reversing table 6-3 is reversed immediately along with rotation of the reversing driving roller 6-6 and is conveyed through the sheet turning unit 10 to the double-sided sheet feeding unit 7 as shown in FIG. 22. The sheet P1 waits at the double-sided sheet feeding unit 7 until the sheet P1 starts to be conveyed to the image forming unit 2. During this period, an image is formed on a first side of the sheet P2, and the sheet P2 temporarily stops before the fixing unit 4. A third sheet P3 is sent from the sheet feeding unit 3 and temporarily stops at the registration rollers 12.

Figure 23:
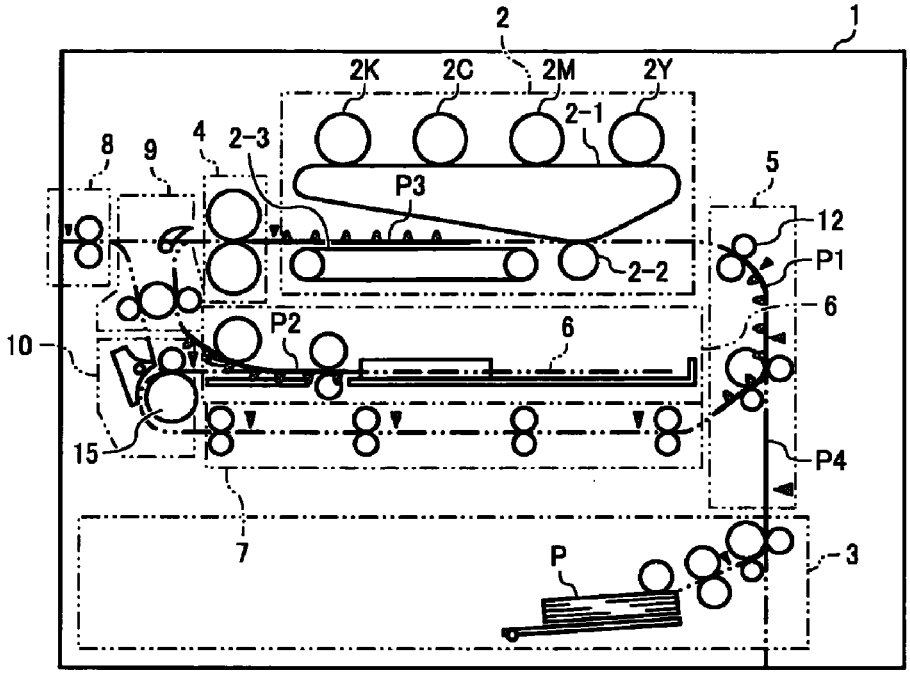
FIG. 23 is a schematic diagram representing a state in which the second sheet enters the reversing table after an image formed on the second sheet is fixed thereto; a third sheet temporarily stops in front of fixing rollers after an image is formed on a first side of the third sheet, and the first sheet temporarily stops at the registration rollers for an image to be formed on its second side.

As shown in FIG. 23, the sheet P2 enters the reversing table 6-3 after an image is fixed thereto, the sheet P3 temporarily stops in front of the fixing unit 4 after an image is formed on a first side of the sheet P3, and the sheet P1 temporarily stops at the registration rollers 12 for image forming on a second side of the sheet P1. At this time, a leading edge of the sheet P3 is sensed by a sensor that is located before the fixing unit 4, and stops in front of a nip between a fixing roller and a heating roller of the fixing unit 4 at which the sheet P3 is not affected by heat.

Figure 24:
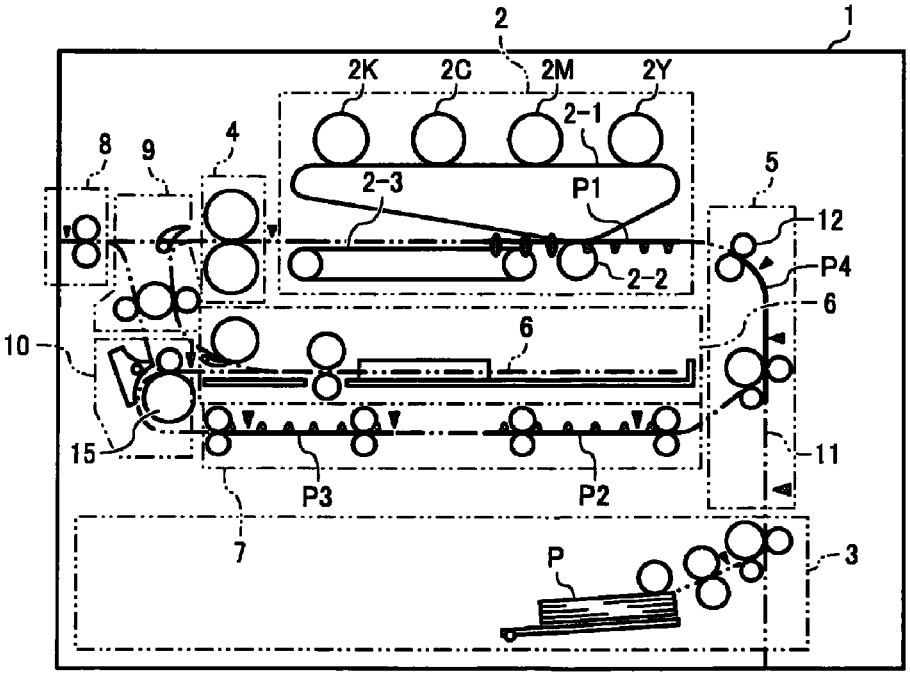
FIG. 24 is a schematic diagram representing a state of starting alternate feeding of sheets.

The alternate feeding starts from this state. As shown in FIG. 24, the sheet P2 temporarily stops at a nip between conveying rollers at a most downstream of the double-sided sheet feeding unit 7, the sheet P3 temporarily stops where a trailing edge of the sheet P3 passes through an inlet of the double-sided sheet feeding unit 7, an image is formed on a second side of the sheet P1, and a fourth sheet P4 is sent from the sheet feeding unit 3 and temporarily stops at the registration rollers 12. A stopping position (or stopping timing) of the sheet P2 is set by sensing a leading edge of the sheet P2 by the sheet sensor 18-9. A stopping position (or stopping timing) of the sheet P3 is set by sensing a leading edge of the sheet P3 by the sheet sensor 18-7 or the sheet sensor 18-8.

The space exists between the sheets P2 and P3 in the stopping position shown in FIG. 24. If a sheet is large in size, a trailing edge of the sheet P2 may be overlapped with a leading edge of the sheet P3, or the sheets may collide with each other. If a sheet is large enough to cause such a state, a leading edge of the sheet P2 is protruded from conveying rollers at the most downstream of the double-sided sheet feeding unit 7, and the trailing edge of the sheet P3 is protruded from conveying rollers at a most upstream of the double-sided sheet feeding unit 7, thereby preventing the trailing edge of the sheet P2 and the leading edge of the sheet P3 from being overlapped or colliding. A protruded amount of the sheets is set based on a length of the conveying path of the double-sided sheet feeding unit 7 and lengths of the sheets.

Figure 25:
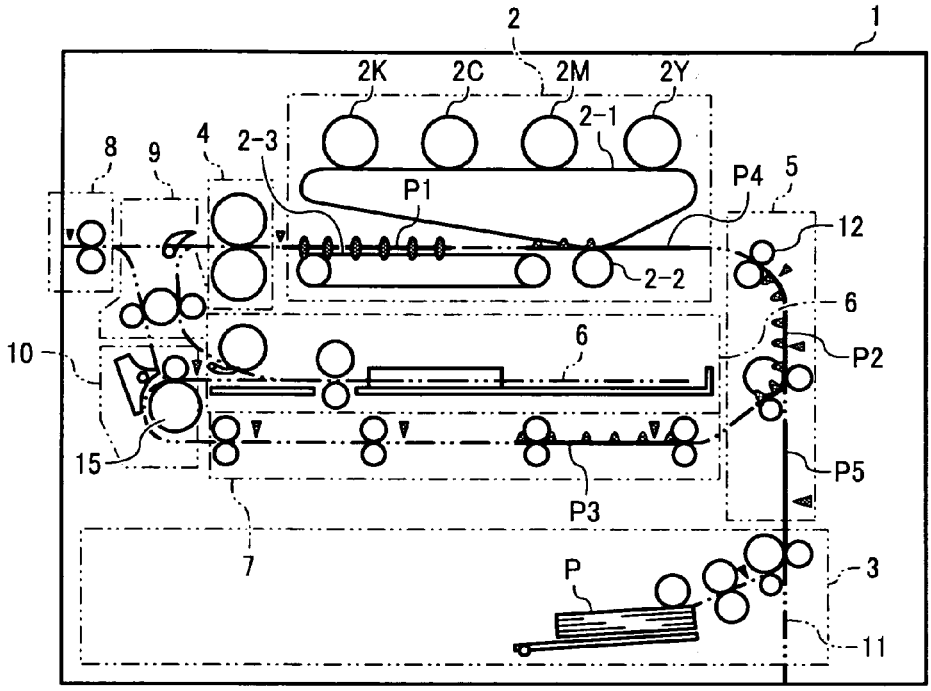
FIG. 25 is a schematic diagram representing a state in which, in a process of alternate feeding, the first sheet reaches in front of the fixing unit after an image is formed on the second side of the first sheet, and an image is formed (transferred) on a first side of a fourth sheet.

The alternate feeding proceeds from the state shown in FIG. 25. An image is formed on a second side of the sheet P1, and the sheet P1 reaches before the fixing unit 4. An image is formed (transferred) oh a first side of the sheet P4. The sheet P2 reaches the registration rollers 12 and temporarily stops at the registration rollers 12. A fifth sheet P5 temporarily stops to move to the registration rollers 12 behind the sheet P2. The sheet P3 temporarily stops at the sheet sensor 18-9. Consequently, no sheet presents in the reversing unit 6.

Figure 26:
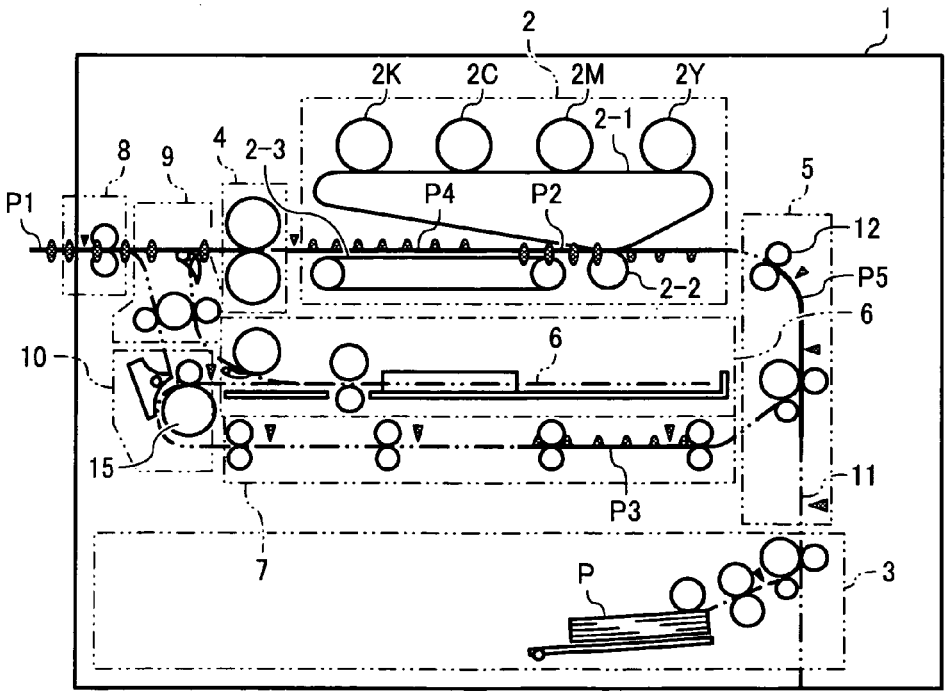
FIG. 26 is a schematic diagram representing a state in which the first sheet is discharged after the image formed on the second side of the first sheet is fixed in the fixing unit, a fourth sheet temporarily stops in front of the fixing unit after an image is formed on a first side of the fourth sheet, and a fifth sheet temporarily stops at the registration rollers.

As shown in FIG. 26, the sheet P1 is discharged after the image formed on the second side of the sheet P1 is fixed thereto in the fixing unit 4, the sheet P4 temporarily stops before the fixing unit 4 with an image formed on its first side, an image is formed on a second side of the sheet P2, the sheet P5 temporarily stops at the registration rollers 12, and the sheet P3 stops as it is in the state shown in FIG. 24.

Figure 27:
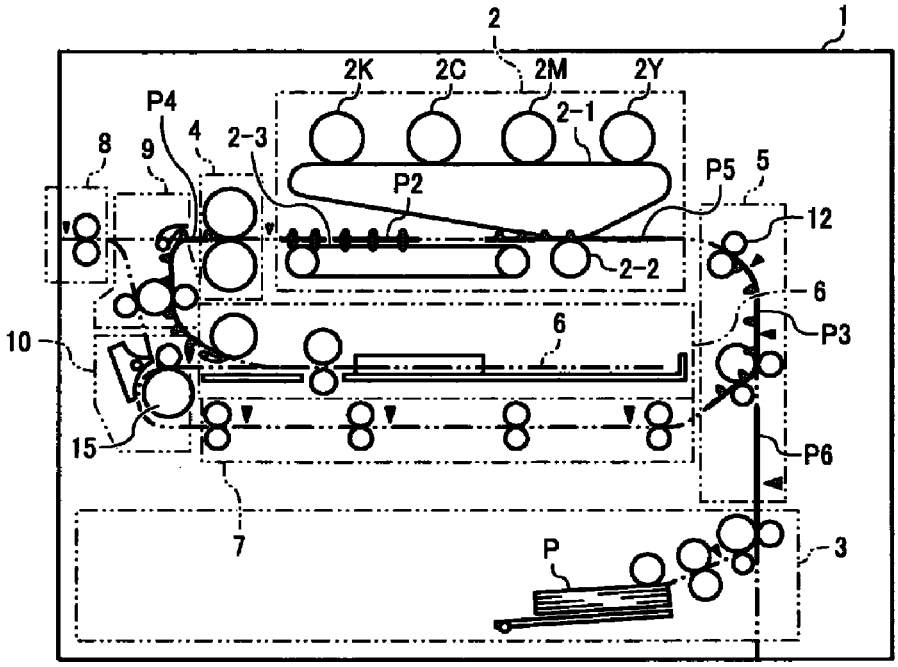
FIG. 27 is a schematic diagram representing a state in which the fourth sheet after passing through the fixing unit is on the conveying path toward the reversing table, and a sixth sheet temporarily stops to be fed behind the third sheet.

As shown in FIG. 27, the sheet P4 is on the conveying path toward the reversing unit 6 after passing through the fixing unit 4, the sheet P2 with an image formed on its second side reaches immediately before the fixing unit 4, an image is formed on a first side of the sheet P5, the sheet P3 temporarily stops at the registration rollers 12, and a sixth sheet P6 temporarily stops to be supplied following the sheet P3.

Figure 28:
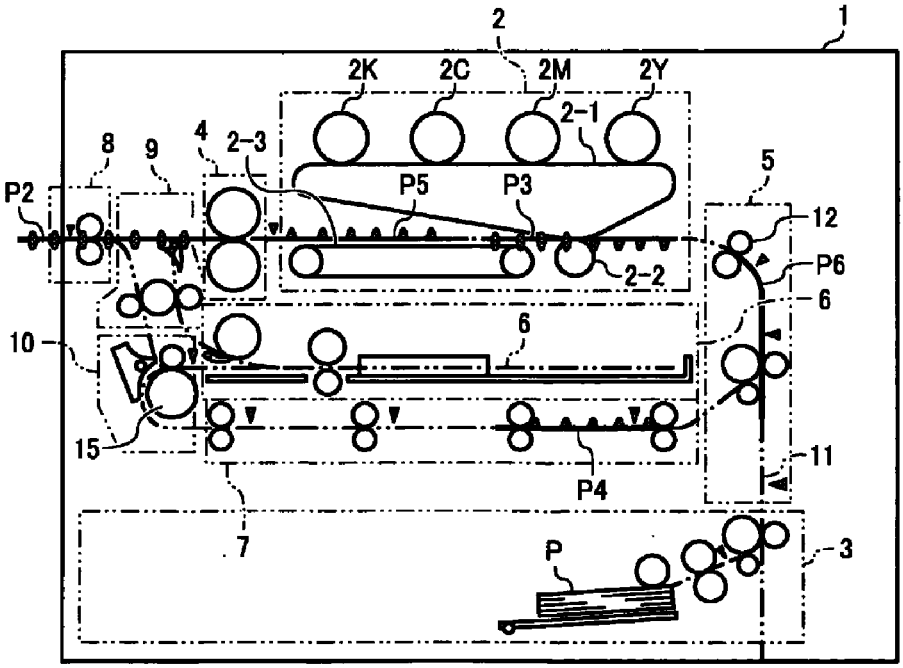
FIG. 28 is a schematic diagram representing a state in which a processing proceeds by one sheet in the same state as that in FIG. 26.
Figure 29:
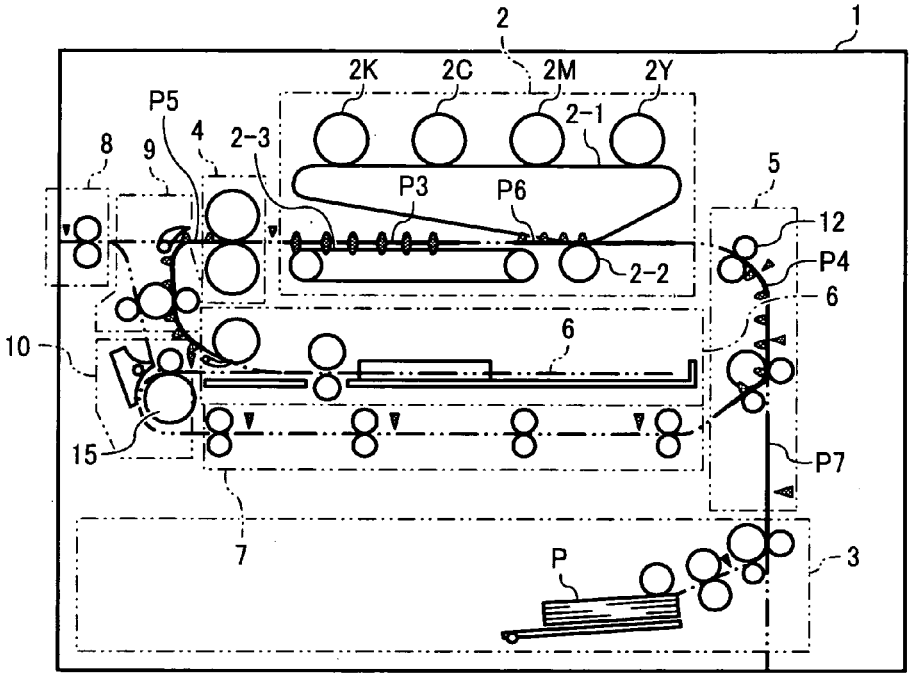
FIG. 29 is a schematic diagram representing a state in which a processing proceeds by one sheet in the same state as that in FIG. 27.
Figure 30:
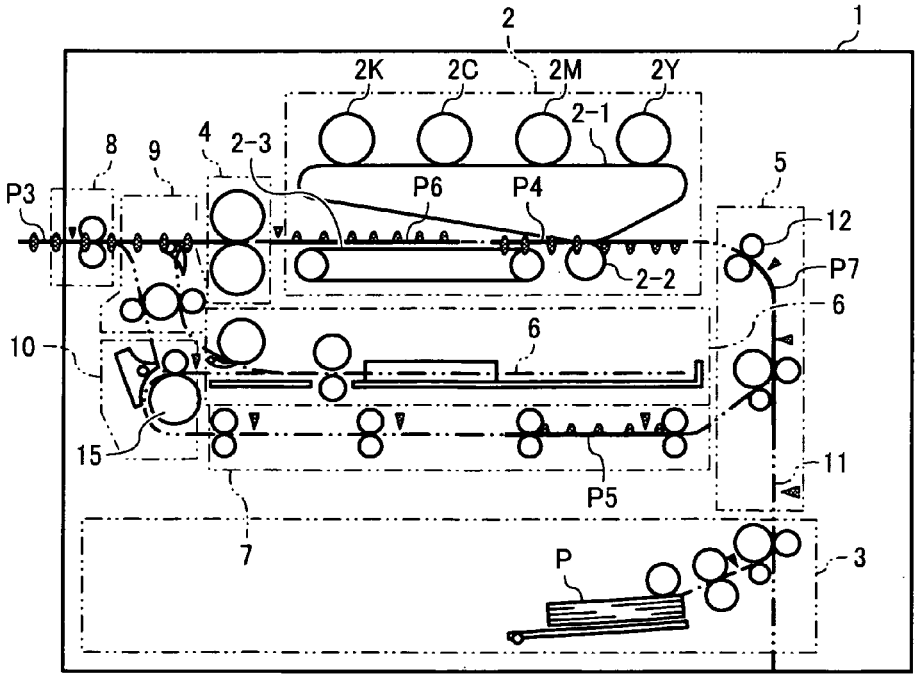
FIG. 30 is a schematic diagram representing a state in which a processing proceeds by one sheet in the same state as that in FIG. 28.

As shown in FIG. 28, sheets are alternately sent one by one from the sheet feeding unit 3 and the double-sided sheet feeding unit 7. FIG. 28 indicates a state in which the processing proceeds by one sheet in the same state in FIG. 26. FIG. 29 indicates a state in which the processing proceeds by one sheet in the same state in FIG. 27. FIG. 30 indicates a state in which the processing proceeds by one sheet in the same state in FIG. 28. The alternate feeding is repeated in such manner. In other words, an operation of alternately forming images on a first side and a second side of a sheet and discharging the sheet with the images formed on both sides is repeated. Five sheets are present in the conveying path of the image forming apparatus 1 at the same time.

As a result, it is possible to keep time required for the sheet to pass through the turn roller 15 after passing the fixing unit 4 constant without stopping at the reversing unit 6. This makes it possible to suppress jamming.

The three-small-sized-sheet interleaf control as in the third example is explained as a fourth example.

Figure 31:
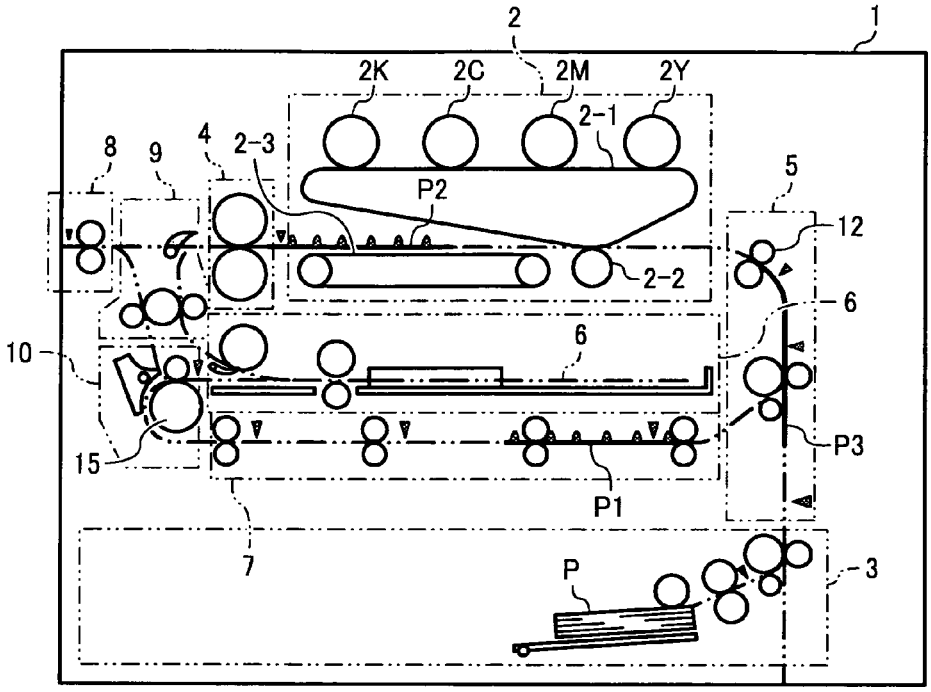
FIG. 31 is a schematic diagram representing a state in which first three sheets are located in the conveying path of the image forming apparatus in a fourth example.
Figure 32:
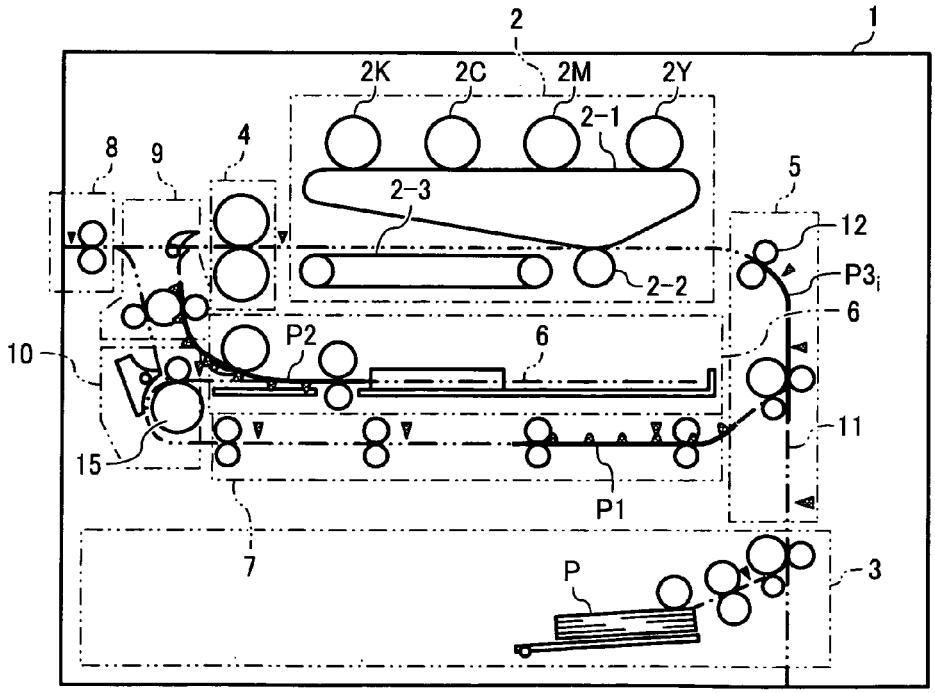
FIG. 32 is a schematic diagram representing a state in which a second sheet is on the conveying path toward the reversing table.
Figure 33:
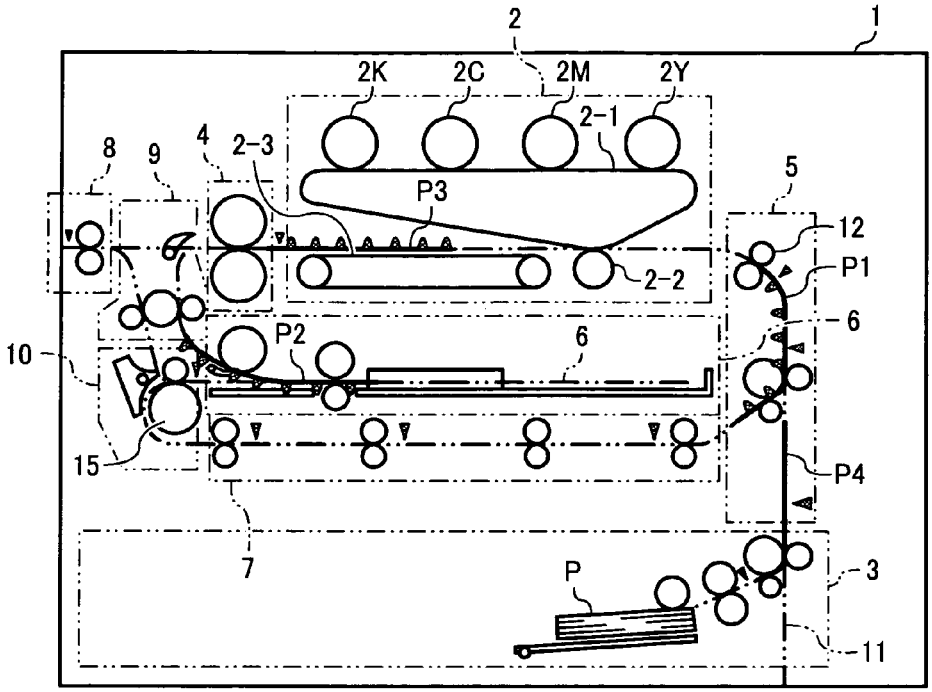
FIG. 33 is a schematic diagram representing a state immediately before starting alternate feeding in the same state as that in FIG. 23 in the third example.

Operations of the three-small-sized-sheet interleaf control are explained referring to FIGS. 31 to 33. The image forming apparatus 1 is the same as that in FIG. 1, so that the same reference numerals are given to the same components of the image forming apparatus 1, and the explanation of the same components is omitted.

First three sheets are located on the conveying path of the image forming apparatus 1 in FIG. 31. An image is formed on a first side of a first sheet P1, a second sheet P2 is sent from the sheet feeding unit 3 and temporarily stops before the fixing unit 4 after an image is formed on a first side of the sheet P2, and a third sheet P3 is located at the registration rollers 12.

Following the state in FIG. 31, a leading edge of the sheet P2 with the image fixed thereto slightly passes beyond the reversing driving roller 6-6, and a leading edge of the sheet P1 slightly protrudes from the double-sided sheet feeding unit 7 as shown in FIG. 32.

FIG. 33 indicates a state immediately before a start of the alternate feeding, which is the same as that in FIG. 23. From the state, the alternate feeding starts. The interleaf control is performed in the same cycle of operations shown in FIGS. 24 to 29 to form images on both sides of sheets.

Components and operations that are not particularly explained are the same as those in the third example.

As a result, it is possible to keep time required for the sheet to pass through the turn roller 15 after passing the fixing unit 4 constant without stopping at the reversing unit 6. This makes it possible to suppress jamming.

The third and fourths examples explain the three-small-sized-sheet interleaf control. In the third example, operations of sheets are set based on a case in which each of sheets temporarily stops at the registration rollers 12. In the fourth example, operations of sheets are set based on a case in which each of sheets temporarily stops immediately before the fixing unit 4. The conventional interleaf control is explained as a second comparative example referring to FIGS. 34 to 38.

Figure 34:
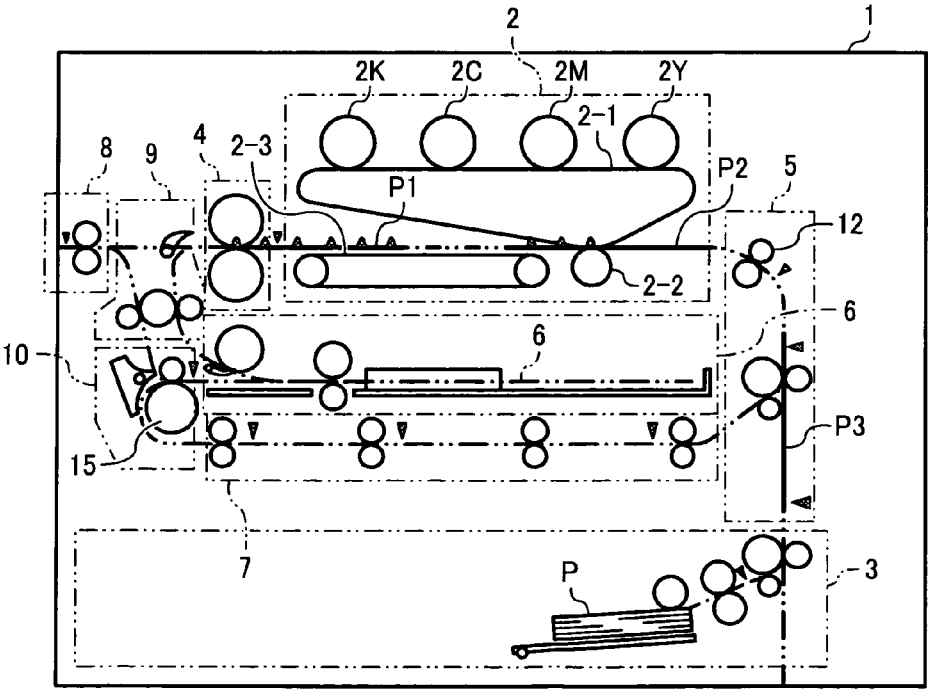
FIG. 34 is a schematic diagram representing a state in which first three sheets are fed in three-sheet Interleaf control in a second comparative example.

As shown in FIG. 34, first three sheets for the three-sheet interleaf control are sent from the sheet feeding unit 3. An image is formed on a first side of a first sheet P1. When a leading edge of the sheet P1 is conveyed to the fixing unit 4, and the image on its first side is fixed to the sheet P1 in the fixing unit 4, an image is formed on a first side of a second sheet P2, and a third sheet P3 is sent from the sheet feeding unit 3. The sheet P3 does not still reach the registration rollers 12.

Figure 35:
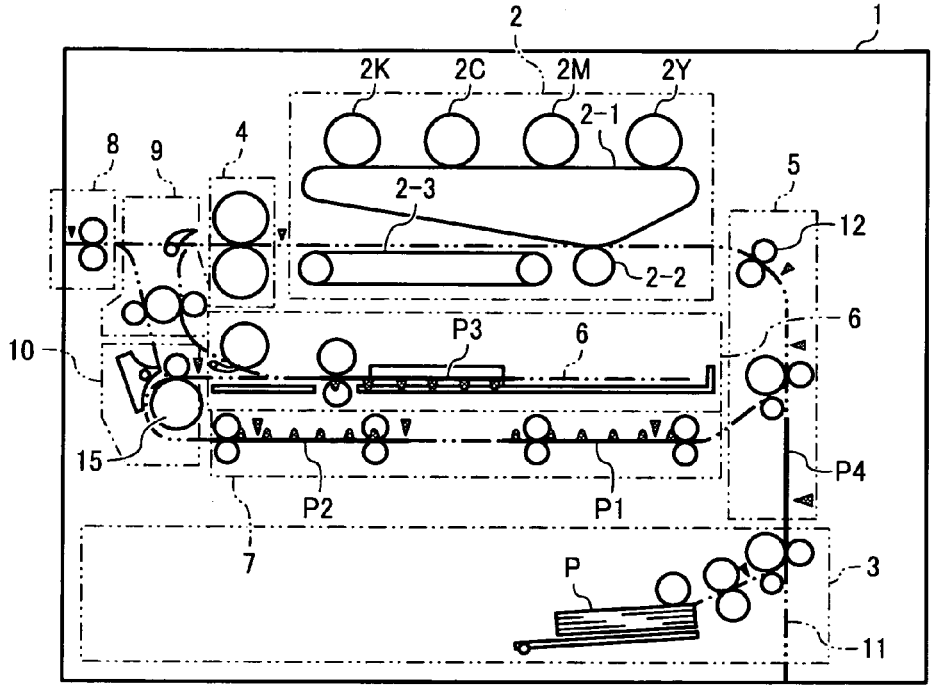
FIG. 35 is a schematic diagram representing a state in which an image is formed on first sides of second and third sheets, and the third sheet temporarily stops on the reversing table.

Following the state in FIG. 34, as shown in FIG. 35, an image is formed on first sides of the sheets P2 and P3, and the sheet P3 temporarily stops on the reversing table 6-3. Under this state, the sheets P1 and P2 are located in the double-sided sheet feeding unit 7. The sheet P1 is on the verge of being conveyed to the registration rollers 12, and a fourth sheet P4 temporarily stops on the vertical conveying path to be conveyed following the sheet P1.

Figure 36:
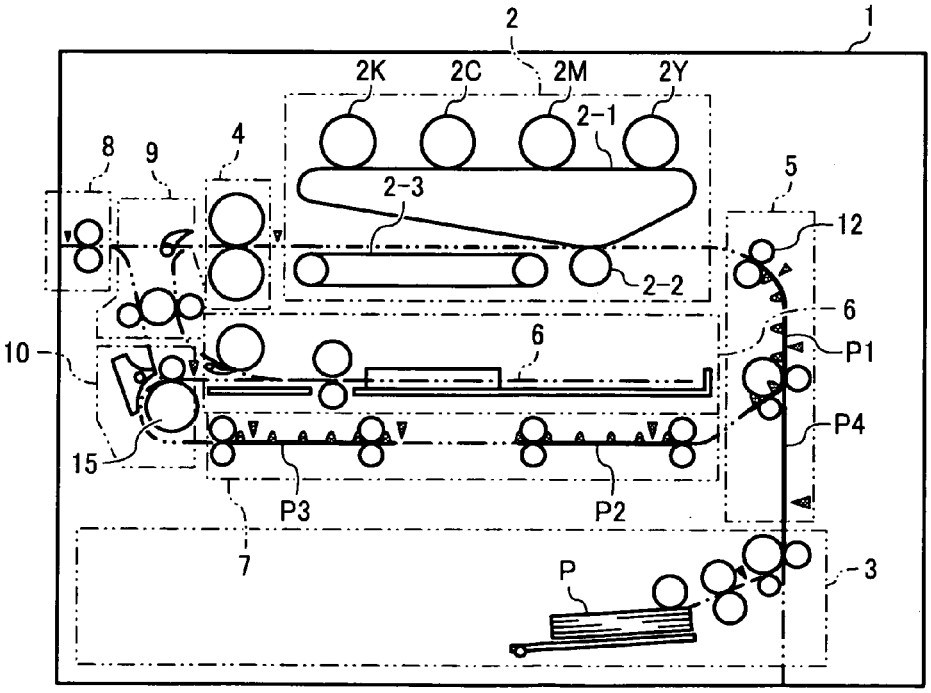
FIG. 36 is a schematic diagram representing a state in which a first sheet moves to the registration rollers, the second sheet temporarily stops at a nip between conveying rollers at the most downstream of the double-sided sheet feeding unit, the third sheet temporarily stops at a position after a trailing edge of the third sheet has passed through an inlet of the double-sided sheet feeding unit, and a fourth sheet temporarily stops just before entering the circular conveying path.

Following the state in FIG. 35, as shown in FIG. 36, the sheet P1 moves to the registration rollers 12, the sheet P2 temporarily stops at a nip between conveying rollers at the most downstream of the double-sided sheet feeding unit 7, the sheet P3 temporarily stops where a trailing edge thereof passes through the inlet of the double-sided sheet feeding unit 7, and the fourth sheet P4 temporarily stops just before the circulating conveying path. The state shown in FIG. 36 is immediately before a start of the alternate feeding. In the alternate feeding, as shown in FIGS. 24 to 30, an operation of alternately forming an image on a first side and a second side of a sheet and discharging the sheet with the images formed on both sides is repeated.

In the second comparative example, as shown in FIG. 35, the sheet P3 temporarily stops on the reversing table 6-3. Therefore, a temperature condition of the sheet P3 is different from that in other sheets because the sheet P3 takes a longer time to pass the turn roller 15 after passing the fixing unit 4. A sheet condition changes due to the difference in the temperature condition, which results in easily causing a sheet jam.

As shown in FIG. 1, the image forming apparatus 1 includes the turn roller 15, which reverses a conveying direction of a sheet along an outer periphery of the roller, at the downstream of the fixing unit 4. When duplex printing is performed with respect to a plurality of sheets in the image forming apparatus 1, and when the preceding sheet temporarily stops at a downstream of the turn roller 15 and at an upstream of the image forming unit 2, the CPU 20 controls the following sheet not to have a stopping time before being reversed by the turn roller 15 at a downstream of the fixing unit 4. When the preceding sheet temporarily stops or it is expected by the sensor that the preceding sheet temporarily stops at the downstream of the turn roller 15 and at the upstream of the image forming unit 2, if the following sheet moves to the reversing unit 6 to approach the preceding sheet (at the downstream of the fixing unit 4 and before being reversed by the turn roller 15), the following sheet needs to temporarily stop at the reversing unit 6 because the preceding sheet temporarily stops at the downstream of the following sheet.

When a sheet temporarily stops at the reversing unit 6, stiffness or curling of the sheet starts changing during the stopping time due to a change of moisture or heat that the sheet has after passing the fixing unit 4. When the sheet passes along the turn roller 15 with stiffness or curling changed, the sheet may jam or the sheet may be conveyed in a folded state.

Specifically, when a sheet is cooled, the sheet becomes stiff, so that the sheet may not turn along the turn roller 15, thereby causing a jam. Moreover, if a sheet is conveyed into the turn roller 15 in a state of being bent due to the change in curl amount, the sheet may be folded.

The CPU 20 (a controller) controls the following sheet not to temporarily stop at the reversing unit 6. Specifically, the CPU 20 controls the following sheet to temporarily stop at an upstream of the fixing unit 4, that is, at the registration rollers 12. Alternatively, the CPU 20 controls the following sheet so that at least a leading edge of the following sheet reaches the turn roller 15.

The embodiment of the present invention can be applied to any one of an image forming apparatus in which a fixed sheet can be reversed and an image forming apparatus in which a fixed sheet can be significantly turned.

According to an aspect of the present invention, it is possible to suppress a sheet jam between a sheet reversing path and a double-sided sheet conveying path.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming mechanism configured to form an image on a first side of a recording medium;

a fixing unit configured to fix an image on the recording medium;

a reversing unit located downstream of the fixing unit, the reversing unit including a curved path having a large curvature configured to convey the recording medium, reverse the recording medium, and convey the recording medium again to the image forming mechanism for forming an image on a second side of the recording medium;

a stopping unit configured to temporarily stop the recording medium between the fixing unit and the image forming mechanism;

a sheet position calculating unit configured to calculate positions of a plurality of recording mediums in a sheet conveyance path based on information obtained from a plurality of sheet sensors and a clock;

a sheet-to-sheet distance calculating unit configured to calculate distances between the plurality of recording mediums based on the positions calculated by the sheet position calculating unit, the sheet-to-sheet distance calculating unit further configured to calculate a delay time for a sheet in the sheet conveyance path, the delay time based on allowable maximum sheet-to-sheet distances obtained from an allowable maximum sheet-to-sheet distance table; and a sheet conveying controller configured to interface with the sheet-to-sheet distance calculating unit to control a group of driving motors based on the delay time.

2. The image forming apparatus according to claim 1, wherein the reversing unit includes a roller along the curved path.

3. The image forming apparatus according to claim 1, wherein the stopping unit is configured to temporarily stop the recording medium just before the fixing unit.

4. The image forming apparatus according to claim 1, further comprising:

a pair of registration rollers having a nip therebetween and located upstream of the image forming mechanism, wherein the stopping unit is further configured to temporarily stop the recording medium in the nip between the registration rollers.

5. The image forming apparatus according to claim 1, wherein the stopping unit is configured to temporarily stop the recording medium after a leading edge of the recording medium passes the curved path when the recording medium needs to temporarily stop after passing through the fixing unit.

6. The image forming apparatus according to claim 1, wherein the stopping unit is configured to set a position for temporarily stopping the recording medium based on a size of the recording medium.

7. The image forming apparatus according to claim 1, wherein the image forming mechanism is configured to form an image on both sides of the recording medium by performing interleaf control.

8. The image forming apparatus according to claim 7, wherein the image forming mechanism includes an image forming unit that includes a plurality of photosensitive elements, the image forming unit being configured to form images of different colors on the photosensitive elements;

an intermediate transfer belt onto which each of the images formed by the image forming unit is primarily transferred; and a secondary transfer unit configured to secondarily transfer a color image formed by superimposing the images on the intermediate transfer belt onto a recording medium, and the color image is formed based on a tandem system.

9. The image forming apparatus according to claim 7, wherein the stopping unit is configured to set a stopping state with respect to the recording medium between a start of forming an image and alternate feeding when the interleaf control is performed.

10. The image forming apparatus according to claim 1, further comprising:

a conveying delay-condition determining unit configured to determine whether the sheet conveying controller performs a conveyance delay control based on a thickness, a size of a sheet, or jam occurrence.

11. The image forming apparatus according to claim 1, wherein one of the sheet sensors of the plurality of sheet sensors is arranged in a sheet conveyance path downstream of the image forming mechanism and upstream of the fixing unit.

* * * * *